US006129467A

United States Patent [19]

Toyosawa et al.

[11] Patent Number: 6,129,467

[45] Date of Patent: Oct. 10, 2000

[54] PRINT IMAGE-FORMING METHOD AND DEVICE AND PRINTING APPARATUS INCORPORATING THE DEVICE

[75] Inventors: Yoshiya Toyosawa, Shiojiri; Kenji Watanabe, Chiyoda-ku; Takuya Suetani, Chiyoda-ku; Kiyoshi Ogawa, Chiyoda-ku; Tomoyuki Shimmra, Chiyoda-ku, all of Japan

[73] Assignee: Seiko Epson Corporation, Tokyo, Japan

[21] Appl. No.: 09/280,382

[22] Filed: Mar. 29, 1999

[30] Foreign Application Priority Data

Mar. 30, 1998 [JP] Japan ..... 10-139257

[51] Int. Cl.[7] ..... B41J 11/26

[52] U.S. Cl. ..... 400/615.2; 400/76; 400/70; 400/61

[58] Field of Search ..... 400/615.2, 76, 400/70, 61

[56] References Cited

U.S. PATENT DOCUMENTS

| | | | |
|---|---|---|---|
| 5,382,100 | 1/1995 | Sakuragi et al. | 400/9 |
| 5,399,030 | 3/1995 | Niwa et al. | 400/61 |
| 5,494,360 | 2/1996 | Watanabe et al. | 400/83 |
| 5,562,353 | 10/1996 | Handa et al. | 400/615.2 |
| 5,649,775 | 7/1997 | Sakuragi et al. | 400/615.2 |
| 5,772,340 | 6/1998 | Nunokawa et al. | 400/70 |
| 5,810,486 | 9/1998 | Hayama et al. | 400/61 |
| 5,868,504 | 2/1999 | Nunokawa et al. | 400/61 |
| 5,887,997 | 3/1999 | Watanabe et al. | 400/615.2 |

FOREIGN PATENT DOCUMENTS

| | | |
|---|---|---|
| 7-114547 | 5/1995 | Japan . |
| 7-114548 | 5/1995 | Japan . |

*Primary Examiner*—John S. Hilten
*Assistant Examiner*—Charles H. Nolan, Jr.
*Attorney, Agent, or Firm*—Hogan & Hartson, LLP

[57] ABSTRACT

There are provided a print image-forming device and device for forming print images and a printing apparatus incorporating the device. A basic image is created which has a plurality of elementary images including at least one fixed-sized elementary image and at least one variable-sized elementary image. A reduced image of the basic image is formed as the print image by reducing at least one of the at least one variable-sized elementary image of the basic image, when the basic image cannot be printed as the print image within the printing area.

33 Claims, 17 Drawing Sheets

FIG. 7

| LEVEL | LEVEL 1 | LEVEL 2 | LEVEL 3 | LEVEL 4 |
|---|---|---|---|---|
| TITLE | STYLE | SELECTED AT LEVEL 1 | SELECTED AT LEVEL 2 | SELECTED AT LEVEL 3 |
| OPTIONS | LETTER SIZE | UNIFORM | | |
| | | EASY AUTO | | |
| | | 1 LINE | F1a<br>S1b<br>M1c<br>L1d<br>VL1e | |
| | | 2 LINES | EASY AUTO | (TO SPECIAL ENTRY SCREEN) |
| | | | LL2a<br>MM2b<br>LS2c<br>SL2d | |
| | | 3 LINES | EASY AUTO | (TO SPECIAL ENTRY SCREEN) |
| | | | UNI3a<br>1L3b<br>2L3c<br>3L3d | |
| | | 4 LINES | EASY AUTO | (TO SPECIAL ENTRY SCREEN) |
| | | | UNI4a<br>1L4b<br>2L4c<br>3L4d<br>4L4e | |
| | | 5 LINES | EASY AUTO | (TO SPECIAL ENTRY SCREEN) |
| | | | UNI5a<br>1L5b<br>2L5c<br>3L5d<br>4L5e<br>5L5f | |
| | | 6 LINES | EASY AUTO | (TO SPECIAL ENTRY SCREEN) |
| | | | UNI6a<br>UP-L6b<br>LOW-L6c | |
| | | 7-10 LINES | | |

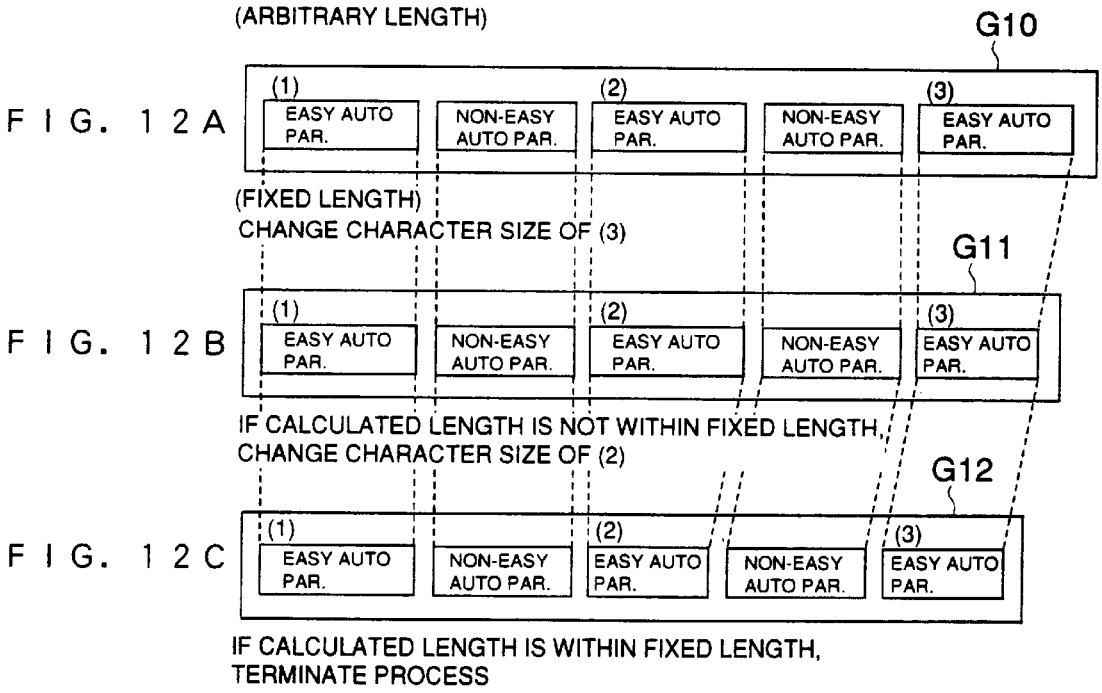
(ARBITRARY LENGTH)
G10
FIG. 12A
(1)
EASY AUTO PAR.
NON-EASY AUTO PAR.
(2)
EASY AUTO PAR.
NON-EASY AUTO PAR.
(3)
EASY AUTO PAR.
(FIXED LENGTH)
CHANGE CHARACTER SIZE OF (3)
G11
FIG. 12B
(1)
EASY AUTO PAR.
NON-EASY AUTO PAR.
(2)
EASY AUTO PAR.
NON-EASY AUTO PAR.
(3)
EASY AUTO PAR.
IF CALCULATED LENGTH IS NOT WITHIN FIXED LENGTH,
CHANGE CHARACTER SIZE OF (2)
G12
FIG. 12C
(1)
EASY AUTO PAR.
NON-EASY AUTO PAR.
(2)
EASY AUTO PAR.
NON-EASY AUTO PAR.
(3)
EASY AUTO PAR.
IF CALCULATED LENGTH IS WITHIN FIXED LENGTH,
TERMINATE PROCESS

FIG. 13

| LINE NUMBER | BASIC SIZE (VERTICAL DOT NO. ×HORIZONTAL DOT NO.) \ LEVEL | 1 | 2 | 3 | 4 | 5 |
|---|---|---|---|---|---|---|
| 1 | G(60×60) | RG | RL | RM | RS | RP |
| | RG(60×(60×0.75) | RL | RM | RS | RP | ← |
| | L(48×48) | RL | RM | RS | RP | ← |
| | RL(48×(48×0.75) | RM | RS | RP | ← | ← |
| | M(32×32) | RM | RS | RP | ← | ← |
| | RM(32×(32×0.75) | RS | RP | ← | ← | ← |
| | S(24×24) | RS | RP | ← | ← | ← |
| | RS(24×(24×0.75) | RP | ← | ← | ← | ← |
| 2 | M+M | RM+RM | RS+RS | RP+RP | ← | ← |
| | M+RM | RM+RM | RS+RS | RP+RP | ← | ← |
| | M+S | RM+RS | RS+RP | ← | ← | ← |
| | M+RS | RM+RP | ← | ← | ← | ← |
| | M+P | RM+RP | ← | ← | ← | ← |
| | M+RP | ← | ← | ← | ← | ← |
| | S+S | RS+RS | RP+RP | ← | ← | ← |
| | S+RS | RS+RP | ← | ← | ← | ← |
| | S+P | RS+RP | ← | ← | ← | ← |
| | S+RP | ← | ← | ← | ← | ← |
| | P+P | RP+RP | ← | ← | ← | ← |
| | P+RP | ← | ← | ← | ← | ← |
| | IP+P | RP+RP | ← | ← | ← | ← |
| | IP+RP | ← | ← | ← | ← | ← |
| 3 | S+P+P | RS+RP+RP | ← | ← | ← | ← |
| | S+P+RP | ← | ← | ← | ← | ← |
| | P+P+P | RP+RP+RP | ← | ← | ← | ← |
| | P+P+RP | ← | ← | ← | ← | ← |
| | P+P+P+P | RP+RP+RP+RP | ← | ← | ← | ← |
| | S+P+P+RP | ← | ← | ← | ← | ← |

G20(M20,R20)

ORIGINAL LENGTH
13.1cm
A B C
NON-EASY AUTO PAR.
D E F G
D E F G H
I J K L M
I J K L M O P
G21(M21 ,R21)

FIXED LENGTH
13cm
G22(M22, R22)

FIXED LENGTH
12cm

FIXED LENGTH
11cm
G23(M23, R23)

FIXED LENGTH
10cm
G24(M24, R24)

FIXED LENGTH
9.5cm
G25(M25, R25)

FIXED LENGTH
9cm
G26(M26, R26)

FIXED LENGTH
8.5cm
G27(M27, R27)

G30(M30,R30)

16.8cm
(ORIGINAL LENGTH)
ABCDEFGH
ABCD
NON-EASY
AUTO PAR
ABCDEFG
NON-EASY
AUTO PAR
ABCDE
ABCDE
ABCD
G31
(M31,
R31)

FIXED LENGTH
16cm
G32
(M32,
R32)

FIXED LENGTH
15cm
G33(M33,
R33)

FIXED LENGTH
14cm
G34(M34,
R34)

FIXED LENGTH
13cm
G35(M35,
R35)

FIXED LENGTH
12cm
G36(M36,
R36)

FIXED LENGTH
11cm

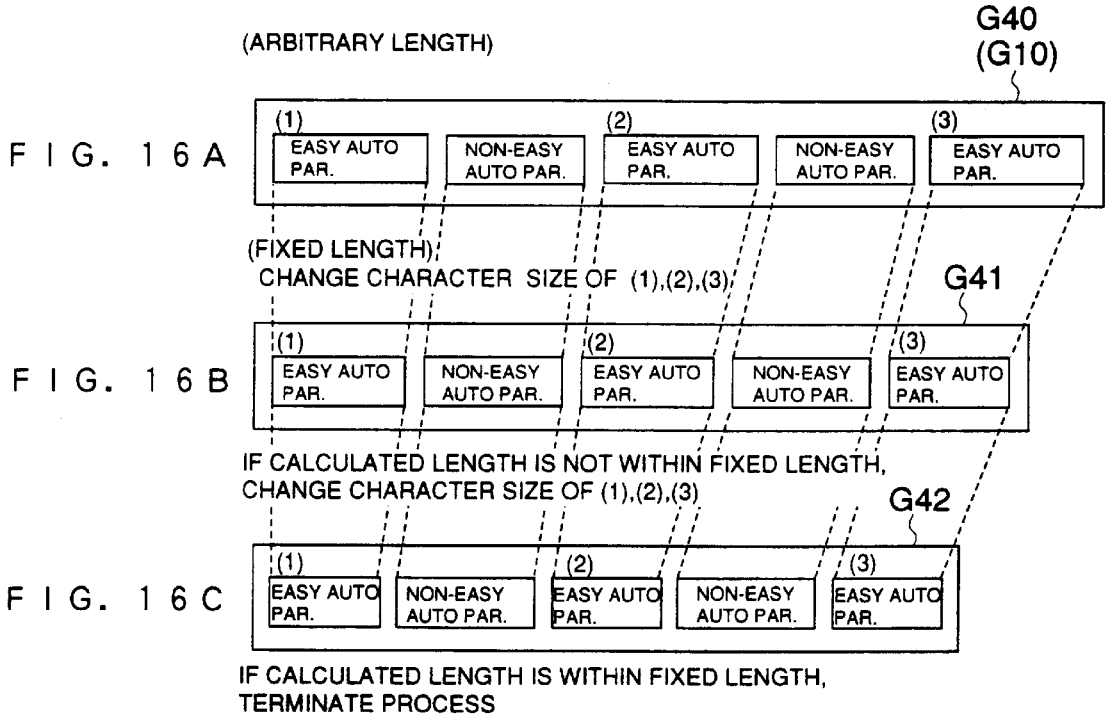
(ARBITRARY LENGTH)
G40
(G10)
FIG. 16A
(1)
EASY AUTO PAR.
NON-EASY AUTO PAR.
(2)
EASY AUTO PAR.
NON-EASY AUTO PAR.
(3)
EASY AUTO PAR.
(FIXED LENGTH)
CHANGE CHARACTER SIZE OF (1),(2),(3)
G41
FIG. 16B
(1)
EASY AUTO PAR.
NON-EASY AUTO PAR.
(2)
EASY AUTO PAR.
NON-EASY AUTO PAR.
(3)
EASY AUTO PAR.
IF CALCULATED LENGTH IS NOT WITHIN FIXED LENGTH,
CHANGE CHARACTER SIZE OF (1),(2),(3)
G42
FIG. 16C
(1)
EASY AUTO PAR.
NON-EASY AUTO PAR.
(2)
EASY AUTO PAR.
NON-EASY AUTO PAR.
(3)
EASY AUTO PAR.
IF CALCULATED LENGTH IS WITHIN FIXED LENGTH,
TERMINATE PROCESS

PRINT IMAGE-FORMING METHOD AND DEVICE AND PRINTING APPARATUS INCORPORATING THE DEVICE

BACKGROUND OF THE INVENTION

1. Field of the Invention

This invention relates to a print image-forming method and device employed in a printing apparatus, such as a tape printing apparatus which is capable of carrying out fixed length printing, for forming a print image to be printed in a preset printing area on a print material, and to a printing apparatus incorporating the print image-forming device.

2. Prior Art

In the tape printing apparatus of this kind which is capable of carrying out fixed length printing, for instance, the length of a printing area of a tape as well as forward and backward margins (forward margin length and backward margin length of the printing area) are set before printing, and after printing, a printed portion of the tape is cut off at a predetermined cutting position, whereby a label or the like having a predetermined length can be created.

In other words, a desired print image is required to be printed in a printing area limited by a preset length or the like. Therefore, a print image-forming device for use with the tape printing apparatus of the above-mentioned kind is required to form a print image such that the print image can be printed in such a preset printing area.

On the other hand, the tape printing apparatus of the above-mentioned kind is capable of printing a plurality of paragraphs arranged along the length of a tape, and a further printing line or a plurality of lines of strings of characters entered and arranged in each paragraph, as well as designating a character size line by line as desired. Further, to save the trouble of specifying the character size, line by line, e.g. for a paragraph having a large number of lines to be printed, it is also possible to collectively specify the character size for all the lines in each paragraph, as shown in FIGS. 17A to 17C.

For instance, in a so-called "Uniform Character Size Mode", as shown in FIG. 17A, an identical character size is automatically set to each of all of a plurality of lines (three lines in the case of the illustrated example) according to the tape width and the number of lines.

Further, as shown in FIG. 17B, when a "Leave-it-to-apparatus Mode" is selected, the character size is automatically set for each line according to the number of characters assigned thereto such that a line having a larger number of characters is set to a smaller character size (see Japanese Laid-Open Patent Publication (Kokai) No. 7-125376) so as to make the character strings substantially identical in length.

Furthermore, in a "Character Size Menu Mode" appearing in FIG. 17C, one of abstract and relative character size settings, "LMS" is selected, for instance, to designate "Large", "Medium" and "Small" character sizes for the three lines, respectively, whereby the three lines are automatically set to respective character sizes according to the designated character sizes (see Japanese Laid-Open Patent Publication (Kokai) No. 6-143690).

The proposed tape printing apparatuses are capable of designating various character size-setting modes paragraph by paragraph, as described above. When a basic image as the source of a print image is created and a fixed length is set to the same, however, if the created basic image cannot be printed in a range of the fixed length (fixed length area), the basic image is uniformly reduced in size without discriminating sizes of paragraphs therein, to fit the same into the fixed length area. Thus, the print image is formed based on the basic image such that it is printable within the fixed length area, and then printed.

In other words, even if various character size-setting modes are freely used to form a basic image, the user's intention which he had in forming the basic image comes to be disregarded when the formed basic image cannot be printed within a fixed length area set by the user.

For instance, according to these tape printing apparatuses, when the user desires to form labels having portions printed with titles of videos or the like such that the portions are identical in size between the labels, and store a plurality of videos having the labels affixed thereto in a state arranged side by side, important paragraphs including the titles of the videos are uniformly reduced similarly to other unimportant paragraphs, if any of the paragraphs is larger than a predetermined length. As a result, the portions of the created labels printed with the titles are reduced in size, which hinders the user from achieving his desired and original object, that is, the object of forming labels having portions printed with titles of videos such that the portions containing the titles are identical in size.

SUMMARY OF THE INVENTION

It is a first object of the invention to provide a print image-forming method and device which is capable of reducing an original basic image based on which a print image is formed, such that the resulting print image can be printed within a preset printing area, and at the same time reflects the user's intention which he had in forming the basic image.

It is a second object of the invention to provide a printing apparatus incorporating the print image-forming device which is capable of reducing an original basic image based on which a print image is formed, such that the resulting print image can be printed within a preset printing area, and at the same time reflects the user's intention which he had in forming the basic image.

To attain the first object, according to a first aspect of the invention, there is provided a method of forming a print image to be printed in a preset printing area on a print material, the method comprising the steps of:

creating a basic image having a plurality of elementary images including at least one fixed-sized elementary image and at least one variable-sized elementary image; and forming a reduced image of the basic image as the print image by reducing at least one of the at least one variable-sized elementary image of the basic image in size, when the basic image cannot be printed as the print image within the printing area.

To attain the above object, according to a second aspect of the invention, there is provided a print image-forming device for forming a print image to be printed in a preset printing area on a print material, the print image-forming device comprising:

basic image-creating means for creating a basic image having a plurality of elementary images including at least one fixed-sized elementary image and at least one variable-sized elementary image; and reduced image-forming means for forming a reduced image of the basic image as the print image by reducing at least one of the at least one variable-sized elementary image of the basic image in size, when the basic image cannot be printed as the print image within the printing area.

According to the print image-forming method and device, a basic image having a plurality of elementary images including at least one fixed-sized elementary image and at least one variable-sized elementary image is created, and to reduce the basic image in size, at least one variable-sized elementary image is reduced in size, so that if the basic image is reduced such that the same can be printed within the preset printing area, the size of each fixed-sized elementary image is not changed.

Therefore, if elementary images are distinguished from each other according to their size characteristics to form a basic image, e.g. by setting an important elementary image as a fixed-sized elementary image and an unimportant elementary image as a variable-sized elementary image, the user's intention which he had in creating the basic image is reflected on a print image as well.

Thus, the print image-forming method and device according to the first and second aspects of the invention is capable of reducing an original basic image in size such that the same can be printed within a preset printing area, and reflecting the user's intention which he had in forming the basic image, on a print image formed by reducing the basic image in size.

Preferably, the step of creating the basic image includes the steps of forming the plurality of elementary images, and setting a size characteristic to each of the elementary images formed, the size characteristic including a setting concerning whether the each of the elementary images formed is one of the at least one fixed-sized elementary image or one of the at least one variable-sized elementary image.

Preferably, the basic image-creating means includes elementary image-forming means for forming the plurality of elementary images, and size characteristic-setting means for setting a size characteristic to each of the elementary images formed, the size characteristic including a setting concerning whether the each of the elementary images formed is one of the at least one fixed-sized elementary image or one of the at least one variable-sized elementary image.

According to these preferred embodiments, elementary images formed are each set as a fixed-sized elementary image or as a variable-sized elementary image. Hence, it is possible to set an important elementary image as a fixed-sized elementary image and an unimportant elementary image as a variable-sized elementary image, for instance, thereby forming a basic image whose elementary images have size characteristics thereof different from each other. This makes it possible to more clearly reflect the user's intention that he had in creating each elementary image of the basic image, on a print image as well.

Further, a size characteristic can be set to each elementary image formed, which makes it possible to cope with an undesired layout or the incapability of printing by changing size characteristics set to elementary images, when it is determined that the print image is not laid out as desired or cannot be printed within the printing area.

Preferably, the step of forming the reduced image includes the steps of selecting at least one scale-down ratio from a plurality of scale-down ratios at which the at least one variable-sized elementary image is reduced in size, and reducing the at least one variable-sized elementary image at the selected at least one scale-down ratio.

Preferably, the reduced image-forming means includes scale-down ratio-selecting means for selecting at least one scale-down ratio from a plurality of scale-down ratios at which the at least one variable-sized elementary image is reduced in size, and reducing means for reducing the at least one variable-sized elementary image at the selected at least one scale-down ratio.

According to these preferred embodiments, it is possible to select a desired scale-down ratio from the scale-down ratios to thereby change the basic image into a reduced image having a desired size which permits the reduced image to be printed within the preset printing area.

More preferably, the step of selecting the at least one scale-down ratio includes selecting the at least one scale-down ratio such that the reduced image has a largest size of all possible sizes to which the basic image can be reduced in size by using the scale-down ratios.

More preferably, the scale-down ratio-selecting means selects the at least one scale-down ratio such that the reduced image has a largest size of all possible sizes to which the basic image can be reduced in size by using the scale-down ratios.

According to these preferred embodiments, a reduced image having the largest size of all possible reduced images printable within the printing area is selected as a print image. This makes it possible to cause a selected print image to have the largest size of all possible print images printable within the printing area, thereby permitting a large and attractive print image to be formed.

More preferably, the step of selecting the at least one scale-down ratio includes the steps of provisionally selecting one of the scale-down ratios in a decreasing order, calculating a size of the reduced image by using at least the provisionally selected scale-down ratio, and actually selecting the provisionally selected scale-down ratio when the calculated size is equal to or smaller than a size of the printing area.

More preferably, the scale-down ratio-selecting means includes provisional selection means for provisionally selecting one of the scale-down ratios in a decreasing order, size-calculating means for calculating a size of the reduced image by using at least the provisionally selected scale-down ratio, and actual selection means for actually selecting the provisionally selected scale-down ratio when the calculated size is equal to or smaller than a size of the printing area.

According to these preferred embodiments, it is possible to reliably obtain a reduced image which can be printed within the printing area from the basic image by using at least one selected scale-down ratios of the plurality of scale-down ratios.

More preferably, the method further includes the step of issuing an error message when a size of the reduced image calculated by applying a smallest scale-down ratio of the scale-down ratios to all of the at least one variable-sized elementary image is larger than a size of the printing area.

More preferably, the print image-forming device further includes notification means for issuing an error message when a size of the reduced image calculated by applying a smallest scale-down ratio of the scale-down ratios to all of the at least one variable-sized elementary image is larger than a size of the printing area.

According to these preferred embodiments, if a reduced image having the smallest size of all images reduced stepwise through a plurality of levels cannot be printed within the printing area, the user is notified of the fact, so that he can recognize that even the reduced image having the smallest size cannot be printed within the printing area. This enable the user to change basic images or letter size-settings, thereby coping with an undesired layout or incapability of printing more quickly.

More preferably, the at least one variable-sized elementary image is constituted by a plurality of variable-sized elementary images, and the step of selecting the at least one scale-down ratio includes the steps of provisionally selecting one of the scale-down ratios in a decreasing order, sequentially increasing a number of selected ones of the variable-sized elementary images to which the provisionally selected scale-down ratio is applied, by an incremental value of one, calculating a size of the reduced image by using at least the provisionally selected scale-down ratio whenever the number of the selected variable-sized elementary images to which the provisionally selected scale-down ratio is applied is increased, and actually selecting at least the provisionally selected scale-down ratio when the calculated size is equal to or smaller than a size of the printing area.

More preferably, the at least one variable-sized elementary image is constituted by a plurality of variable-sized elementary images, and the scale-down ratio-selecting means includes provisional selection means for provisionally selecting one of the scale-down ratios in a decreasing order, applied variable-sized elementary image number-increasing means for sequentially increasing a number of selected ones of the variable-sized elementary images to which the provisionally selected scale-down ratio is applied, by an incremental value of one, size-calculating means for calculating a size of the reduced image by using at least the provisionally selected scale-down ratio whenever the number of the selected variable-sized elementary images to which the provisionally selected scale-down ratio is applied is increased, and actual selection means for actually selecting at least the provisionally selected scale-down ratio when the calculated size is equal to or smaller than a size of the printing area.

According to these preferred embodiments, even when an identical scale-down ratio is employed, the variable-sized elementary images can be reduced through number of steps corresponding in number to the number of variable-sized elementary images, so that reduced images identical in number to the number of reduction steps can be each sequentially made a candidate, thereby enabling delicate or accurate scale-down processing to be carried out. This makes it possible to form a print image more suitable for the printing area therefor.

More preferably, the at least one variable-sized elementary image is constituted by a plurality of variable-sized elementary images, and the step of selecting the at least one scale-down ratio includes the steps of provisionally selecting one of the scale-down ratios in a decreasing order, calculating a size of the reduced image by applying the provisionally selected scale-down ratio to all of the variable-sized elementary images, and actually selecting the provisionally selected scale-down ratio when the calculated size is equal to or smaller than a size of the printing area.

More preferably, the at least one variable-sized elementary image is constituted by a plurality of variable-sized elementary images, and the scale-down ratio-selecting means includes provisional selection means for provisionally selecting one of the scale-down ratios in a decreasing order, size-calculating means for calculating a size of the reduced image by applying the provisionally selected scale-down ratio to all of the variable-sized elementary images, and actual selection means for actually selecting the provisionally selected scale-down ratio when the calculated size is equal to or smaller than a size of the printing area.

According to these preferred embodiments, a plurality of variable-sized elementary images are simultaneously reduced by using one scale-down ratio in one scale-down step. Therefore a reduction size at one reduction level can be made large, which enables scale-down processing speed to be increased when the size of a basic image is much larger than the size of a printable print image, for instance.

Preferably, the at least one variable-sized elementary image includes one containing at least one character image, the at least one character image having a plurality of character sizes to which the at least one character image can be set, and the step of forming the reduced image includes changing an original character size of each of the at least one character image to a character size smaller than the original character size by selecting an appropriate one of the character sizes.

Preferably, the at least one variable-sized elementary image includes one containing at least one character image, the at least one character image having a plurality of character sizes to which the at least one character image can be set, and the reduced image-forming means includes character size-changing means for changing an original character size of each of the at least one character image to a character size smaller than the original character size by selecting an appropriate one of the character sizes.

According to these preferred embodiments, at least one variable-sized elementary image includes one having at least one character image, and the character image has a plurality of sizes which can be set. Hence, in scale-down processing for reducing the variable-sized elementary image having at least one character image, the size of each character image is reduced, whereby the variable-sized elementary image can be reduced. Since printing apparatuses normally have a plurality of sizes of character images, the scale-down processing can be easily carried out simply by changing the sizes of character images.

More preferably, the variable-sized elementary image containing the at least one character image includes a variable-sized elementary image containing a plurality of lines of character images, and the step of forming the reduced image includes selectively setting the character sizes to the plurality of lines such that the character images are reduced at an identical scale-down ratio.

More preferably, the variable-sized elementary image containing the at least one character image includes a variable-sized elementary image containing a plurality of lines of character images, and the reduced image-forming means includes character size-setting means for selectively setting the character sizes to the plurality of lines such that the character images are reduced at an identical scale-down ratio.

According to these preferred embodiments, at least one variable-sized elementary image having at least one character image includes a variable-sized elementary image having a plurality of lines, and scale-down processing for reducing the variable-sized elementary image having the plurality of lines is carried out in a manner such that character images on the plurality of lines are reduced at an identical scale-down ratio. Therefore, the variable-sized elementary image can be reduced in size without changing appearances of the line relative to each other, whereby it is possible to reflect on a print image the user's intention, that is, the relationship in size between the character images which the user set or desired in forming the basic image.

Preferably, the at least one variable-sized elementary image includes one containing a plurality of character images and at least one blank image located between adjacent ones of the character images, the at least one blank image being each formed of an image other than character images, and the step of forming the reduced image includes reducing a size of each of the at least one blank image.

Preferably, the at least one variable-sized elementary image includes a variable-sized elementary image containing a plurality of character images and at least one blank image located between adjacent ones of the character images, the at least one blank image being each formed of an image other than character images, and the reduced image-forming means includes means for reducing a size of each of the at least one blank image.

According to these preferred embodiments, the at least one variable-sized elementary image includes a variable-sized elementary image having blank images located between adjacent ones of the character images thereof. As to such a variable-sized elementary image, it is possible to easily carry out scale-down processing simply by reducing the blank images.

Preferably, the at least one variable-sized elementary image includes one containing at least one character image and marginal blank images forward and backward of the at least one character image, and the step of forming the reduced image includes reducing a size of the marginal blank images.

Preferably, the at least one variable-sized elementary image includes a variable-sized elementary image containing at least one character image and marginal blank images forward and backward of the at least one character image, and the reduced image-forming means includes means for reducing a size of the marginal blank images.

According to these preferred embodiments, at least one variable-sized elementary image includes a variable-sized elementary image having marginal blank images forward and backward thereof. As to such a variable-sized elementary image, it is possible to easily carry out scale-down processing simply by reducing the marginal blank images.

Preferably, the print material is a tape.

According to these preferred embodiments, since the print material is a tape, the print image-forming method and device can be applied to ones for a tape printing apparatus.

More preferably, the basic image is formed by arranging the plurality of elementary images in a direction corresponding to a direction of a length of the tape.

According to these preferred embodiments, a basic image is formed by arranging each elementary image in a direction corresponding to the direction of the length of a tape, and hence the print image-forming method and device are suitable for a tape printing apparatus in which a fixed length can be set, e.g. when the user desires to form a print image printable within a range of the fixed length.

Preferably, plurality of elementary images correspond respectively to a plurality of paragraphs to be printed on the tape.

In general, in tape printing apparatuses, an organized portion of writing and the like (including numerals, symbols and simple figures as well as slightly complicated figures or the like registered as nonstandard characters) is compiled as one paragraph, so that contents (aims) expressed by images in paragraphs and degrees of importance of the paragraphs are different from each other. According to these preferred embodiments, each of the plurality of elementary images corresponds to one of a plurality of paragraphs to be printed on the tape. Hence, if a basic image is created in a manner such that images in the paragraphs are distinguished from each other according to their importance, when the basic image is reduced in size as well, the aim or degree of importance of each paragraph is reflected on a print image. This makes it possible to clearly reflect the user's intention which he had in forming the basic image.

As a result, e.g. in the tape printing apparatus to which the print image-forming method and device is applied, when the user desires to form labels having portions to be printed with titles of videos or the like produced such that the portions are identical in size, and store a plurality of videos with the labels affixed thereto side by side, the user can set important paragraphs of titles of videos and the like to fixed-sized paragraphs, while setting paragraphs of information, such as dates or the like, to variable-sized paragraphs. This enables the user to form a print image having his intention reflected thereon and print the print image, to thereby create desired labels (for instance, labels having portions printed with titles of videos identical in size to each other).

To attain the second object, according to a third aspect of the invention, there is provided a printing apparatus comprising a print image-forming device for forming a print image to be printed in a preset printing area on a print material, the print image-forming device including basic image-creating means for creating a basic image having a plurality of elementary images including at least one fixed-sized elementary image and at least one variable-sized elementary image, and reduced image-forming means for forming a reduced image of the basic image as the print image by reducing at least one of the at least one variable-sized elementary image of the basic image in size, when the basic image cannot be printed as the print image within the printing area, and printing means for printing the print image formed by the print image-forming device in the printing area.

Since this printing apparatus incorporates the print image-forming device, it can have the above-described advantages and is capable of reflecting the user's intention which he had in forming a basic image and printing a formed print image in a printing area set in advance.

The above and other objects, features, and advantages of the invention will become more apparent from the following detailed description taken in conjunction with the accompanying drawings.

BRIEF DESCRIPTION OF THE DRAWINGS

FIG. 7 is a diagram showing a hierarchical structure of options for designating letter sizes;

FIGS. 12A to 12C are diagrams schematically showing, by way of example, images of image data items processed by the FIG. 11 fixed length layout process, in which:

FIG. 12A shows a basic image (print image data);

FIGS. 12B and 12C show reduced images formed by reducing the size of the FIG. 12A basic image, respectively;

FIG. 13 shows a table of character sizes at character size reduction levels;

FIGS. 16A to 16C, which are similar to FIGS. 12A to 12C, schematically show, by way of example, images of image data items processed by the FIG. 11 fixed length layout process.

DETAILED DESCRIPTION

The invention will now be described in detail with reference to drawings showing an embodiment thereof. In this embodiment, a print image-forming method and device for forming print images and a printing apparatus incorporating the device, according to the invention, are applied to a tape printing apparatus.

The tape printing apparatus 1 prints desired letters and figures on a printing tape (tape) T loaded in the apparatus in a state contained within a tape cartridge 5, and cuts off a printed portion of the tape T to a predetermined length to make a label.

Figure 1:
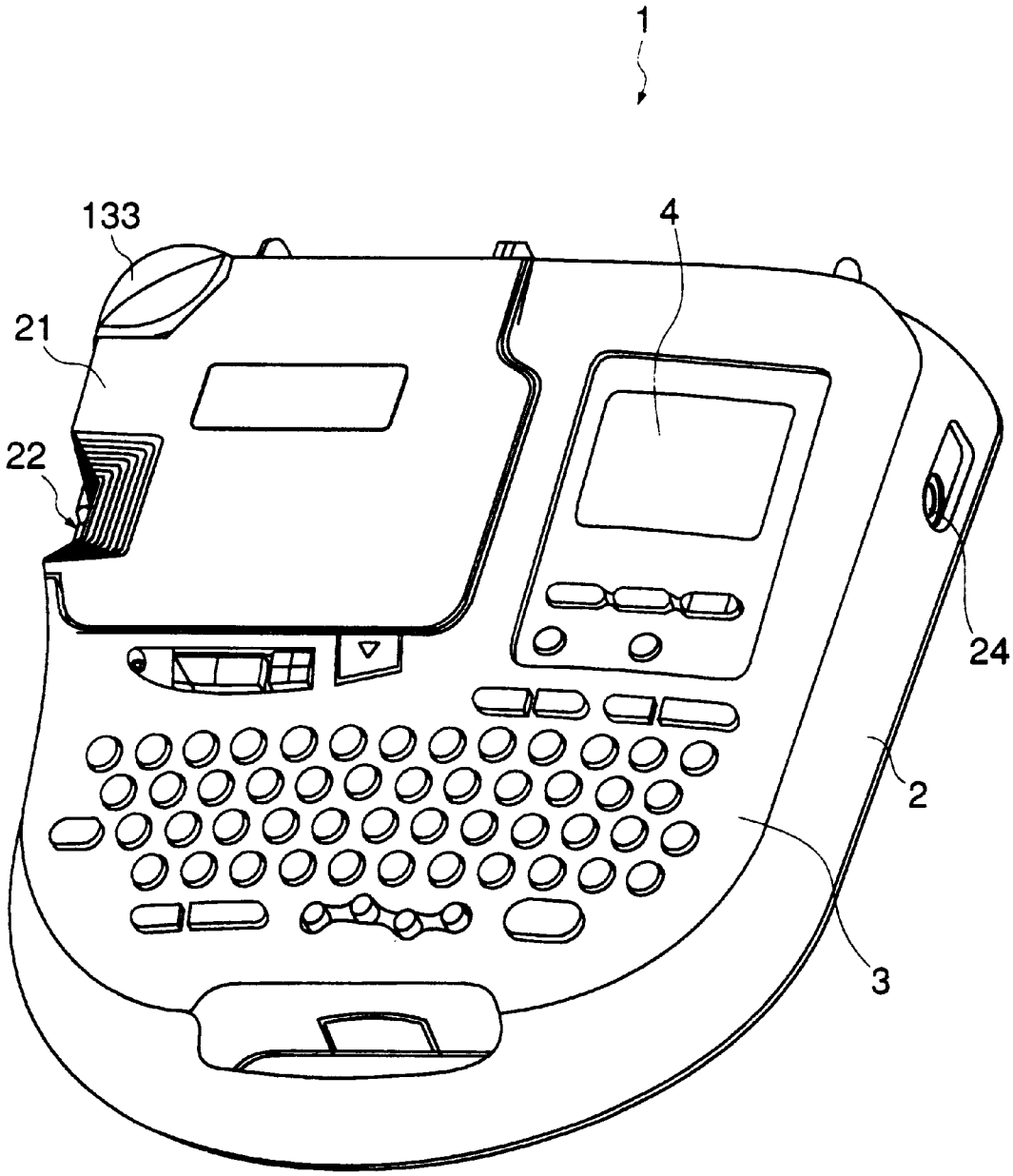
FIG. 1 is a perspective view of an appearance of a tape printing apparatus according to an embodiment of the invention.

Referring first to FIG. 1, the tape printing apparatus 1 includes a casing 2 having upper and lower divisional portions, a keyboard 3 arranged on the top of the front portion thereof, as well as a lid 21 and a display 4 arranged on the left-hand side and the right-hand side of the top of the rear portion thereof, respectively. The keyboard 3 is comprised of various kinds of entry keys.

Figure 2:
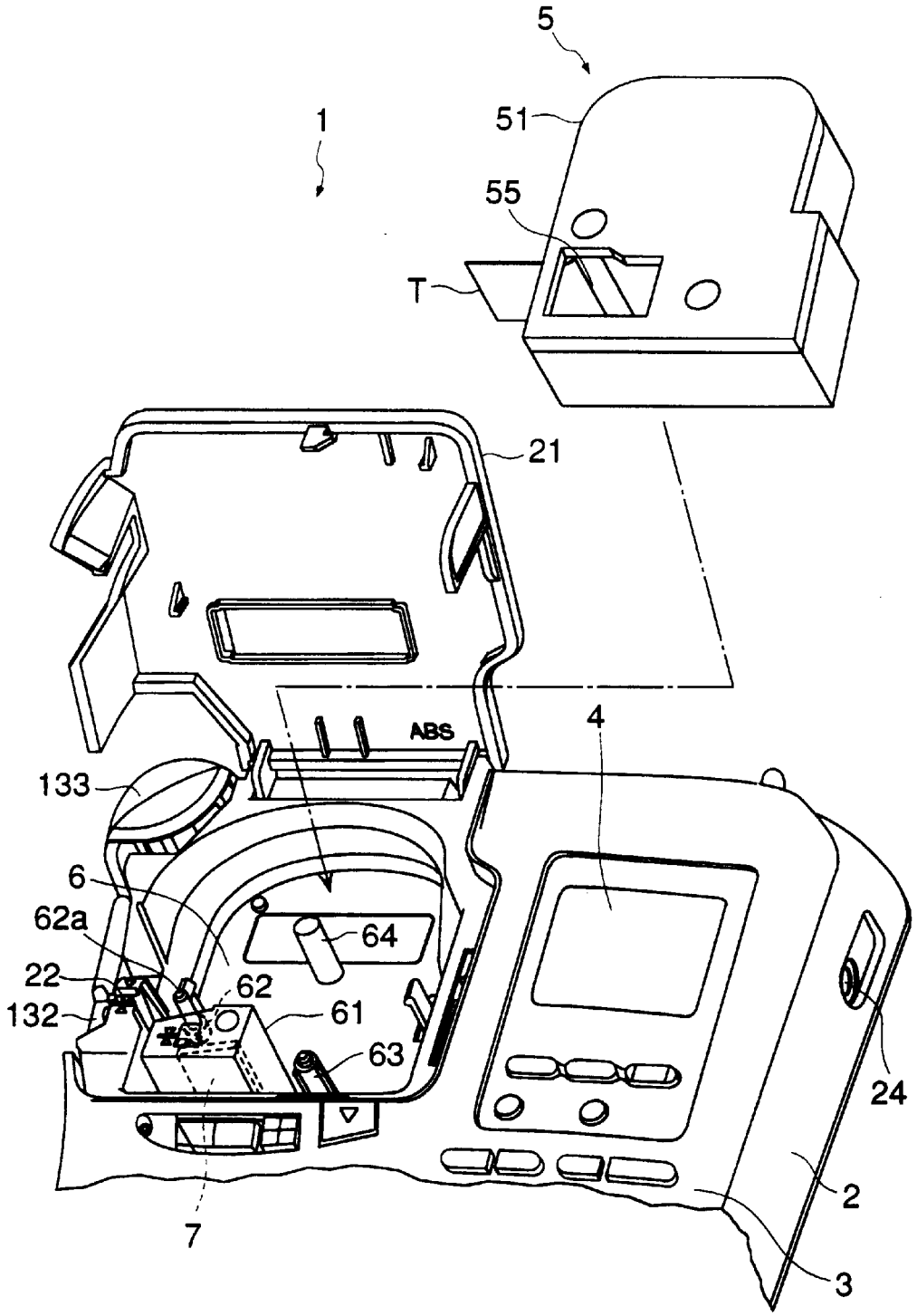
FIG. 2 is a fragmentary view in perspective of the tape-printing apparatus, in a state in which a lid of the tape-printing apparatus is opened and a tape cartridge is removed therefrom.

As shown in FIG. 2, arranged under the lid 3 is a compartment 6 for loading the tape cartridge 5 therein. The tape cartridge 5 is mounted in and removed from the compartment 6 in a state of the lid 21 being opened.

The tape cartridge 5 contains a tape T having a predetermined width (which varies from approximately 4.5 to 48 mm according to the type of tape). The tape cartridge 5 has a plurality of small holes formed in the bottom thereof for discriminating a type of tape T contained therein from the other types of tape T having different widths and contained in other tape cartridges 5. The compartment 6 has a tape-discriminating sensor 142 (see FIG. 4), comprised e.g. of micro-switches, for detecting these holes to thereby determine a type of a tape T.

The compartment 6 is provided with an ambient temperature sensor 143 (see FIG. 4), such as a thermistor, which sends information of an ambient temperature detected thereby to a control block 200 described hereinbelow. Further, the casing 2 has a left side portion thereof formed with a tape exit 22 via which the compartment 6 and the outside of the apparatus communicate with each other. A tape cutter 132 faces the tape exit 22 for cutting a printed portion of the tape T for delivery (see FIG. 4).

Figure 4:
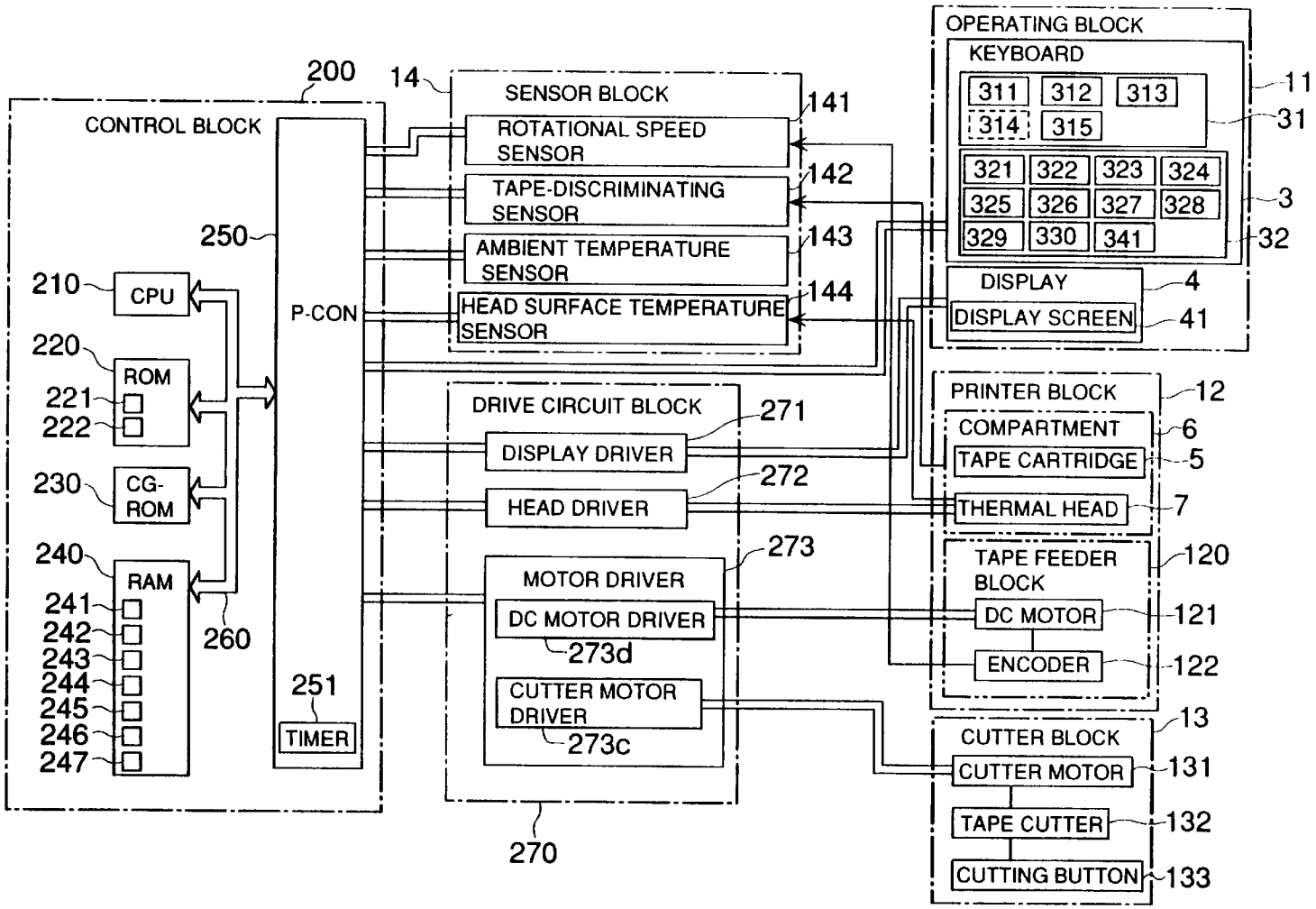
FIG. 4 is a block diagram schematically showing a control system of the FIG. 1 tape printing apparatus.

Referring to FIG. 4, the tape printing apparatus 1 is basically comprised of an operating block 11 having the keyboard 3 and the display 4 for interfacing with the user, a printer block 12 having a thermal head 7, and a tape feeder block 120, for printing on a tape T unwound from the tape cartridge 5 loaded in the compartment 6, a cutter block 13 for cutting off a printed portion of the tape T, a sensor block 14 having various sensors for carrying out detecting operations, a drive circuit block 270 having drivers for driving various circuits, and the control block 200 for controlling blocks or components in the tape printing apparatus 1.

The casing 2 accommodates a circuit board 23, not shown, in addition to the printer block 12, the cutter block 13, the sensor block 14, and so forth. On the circuit board are mounted a power supply unit as well as the drive circuit block 270, described hereinafter, the control block 200, and other circuits, which are connected to batteries, such as nicad batteries, removably mounted from the outside of the casing 2, and to a connector socket 24 connectable with an AC adapter.

In the tape printing apparatus 1, the user, after loading the tape cartridge 5 in the compartment 6, enters printing information of print images, such as desired characters (letters, numerals, symbols, figures and the like), via the keyboard 3, and at the same time confirms or views results of the entry on the display 4 for editing the same.

Thereafter, when the user instructs a printing operation via the keyboard 3, the tape feeder block 120 is driven to unwind the tape T from the tape cartridge 5, and at the same time the thermal head 7 is driven to print characters on the tape T as desired.

The printed portion of the tape T is delivered from the tape exit 22, as the printing operation proceeds. When the desired characters have been printed in the above manner, the tape feeder block 120 further sends the tape T to a position at which terminates a tape length (the length of a label to be formed) including the length of a marginal area, and then stops the tape feed.

The cutter block 13 includes a tape cutter 132, a cutting button 133 for manually causing the tape cutter 132 to carry out a cutting operation e.g. during an arbitrary length printing, and a cutter motor 131 for automatically causing the tape cutter 132 to carry out a cutting operation e.g. during a fixed length printing (see FIG. 4). Accordingly, the tape printing apparatus 1 is configured to selectively set an automatic cutting mode and a manual cutting mode.

As a result, in the manual cutting mode, when the printing operation is completed, the user pushes the cutting button 133 arranged on a left-side rear portion of the casing 2 (see FIGS. 1 and 2), whereby the tape cutter 132 is actuated to cut the tape T to a desired length. In the automatic cutting mode, after completion of the printing operation, the tape T is further fed by the length of a marginal area, and then stopped, whereupon the cutter motor 131 is driven to cut off the tape T.

Figure 3:
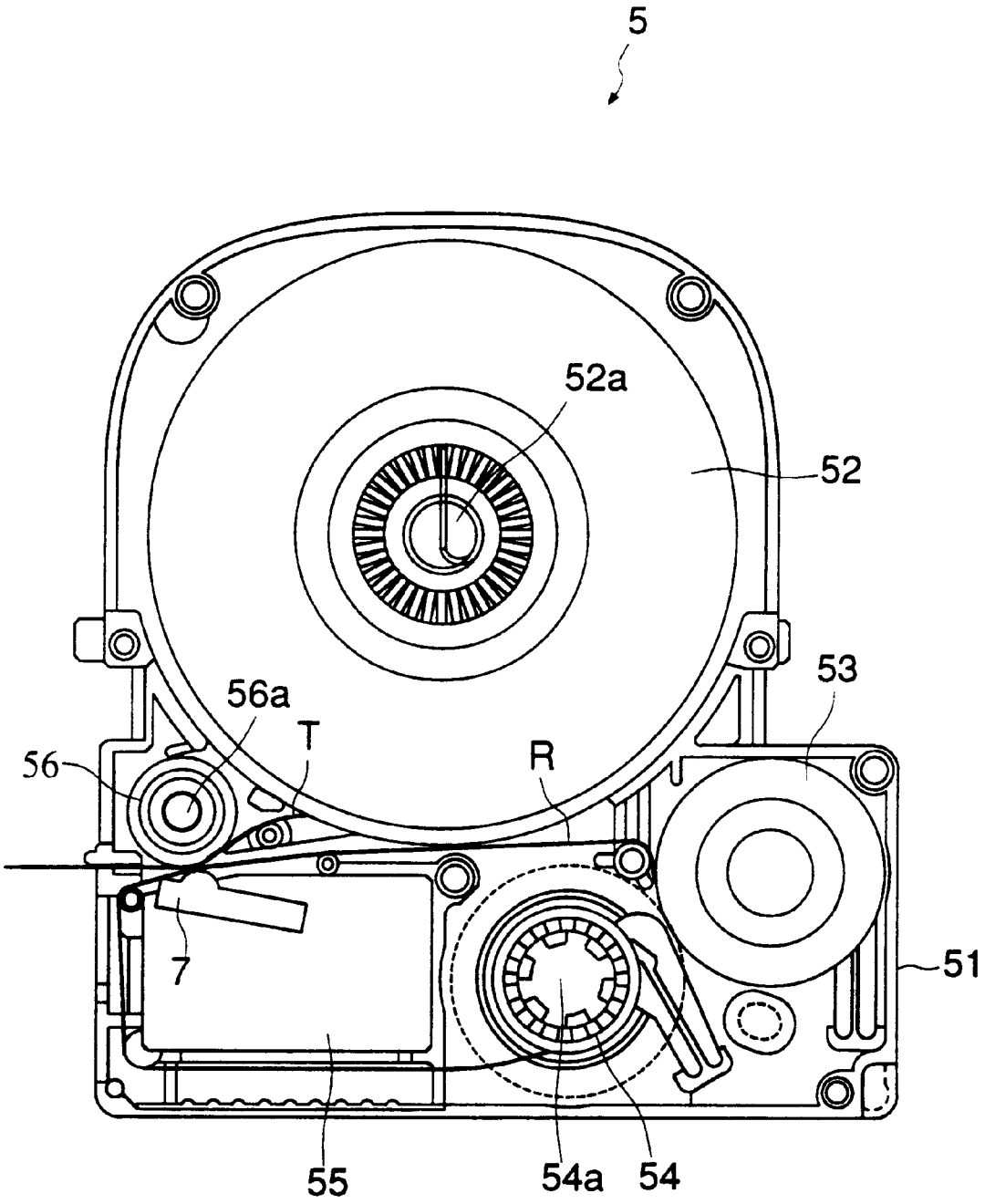
FIG. 3 is a plan view showing, by way of example, an internal construction of the tape cartridge.

Next, the printer block 12 will be described. Referring to FIGS. 2 and 3, the tape cartridge 5 contains the tape T and an ink ribbon R within a cartridge casing 51. The tape cartridge 5 has a through hole 55 formed at a left-hand side lower portion thereof, as viewed in FIG. 3. The through hole 55 is provided for fitting the tape cartridge 5 on a head unit 61 arranged in the compartment 6. Further, a platen roller 56 is arranged within the tape cartridge at a location where the tape T and the ink ribbon R are placed one upon the other, in a manner corresponding to the thermal head 7 incorporated in the head unit 61.

In the compartment 6, in a manner corresponding to component parts of the tape cartridge 5, there are provided a platen drive shaft 62 for engagement with the platen roller 56 to drive the same for rotation, a take-up drive shaft 63 for engagement with a ribbon take-up reel 54 to drive the same for rotation, and a positioning pin 64, each of which extends perpendicularly upward from the bottom of the compartment 6.

When the tape cartridge 5 is loaded in the compartment 6, the through hole 55 of the tape cartridge 5 is fitted on the head unit 61, (the center hole 52*a* of) a tape reel 52 thereof is fitted on the positioning pin 64, (the center hole 56*a* of) the platen roller 56 is fitted on the platen drive shaft 62, and (the center hole 54*a* of) the ribbon take-up reel 54 is fitted on the take-up drive shaft 63, which enables the feed of the tape T and the ink ribbon R. In this state, when the lid 21 is closed, the thermal head 7 is brought into contact with the platen roller 56 in a manner sandwiching the tape T and the ink ribbon R therebetween, thereby enabling a printing operation.

The tape T is rolled out from the tape reel 52, and at the same time the ink ribbon R is rolled out from a ribbon reel 53 and fed or run together with the tape T in a state lying upon the tape T, followed by being taken up by the ribbon take-up reel 54. In other words, the platen roller 56 and the ribbon take-up reel 54 rotate in synchronism with each other, whereby the tape T and the ink ribbon R are fed simultaneously, and at the same time the thermal head 7 is driven in synchronism with movement of the platen roller 56 and the ribbon take-up reel 54 to thereby carry out a printing operation.

Further, after completion of the printing operation, the platen roller 56 continues to rotate for a predetermined time period (the ribbon take-up reel 54 also continues to rotate in synchronism with rotation of the platen roller 56), whereby the tape T continues to be fed until a predetermined cutting position (at which the tape length terminates) on the tape T reaches the position of the tape cutter 132.

It should be noted that a head surface temperature sensor 144 (see FIG. 4) formed by a thermistor as the like is arranged on a surface of the thermal head 7 in intimate contact therewith, which sends information of a surface temperature of the thermal head detected thereby to the control block 200 described hereinafter.

The tape feeder block 120, which rotates the platen drive shaft 62 and the take-up drive shaft 63 by using a DC motor 121 (see FIG. 4) arranged beside the compartment 6 as a power (drive) source, is arranged in a space extending from a location laterally outward of the compartment 6 to a location downward of the same, as viewed in FIG. 1.

The tape feeder block 120 is comprised of the DC motor 121, the platen drive shaft 62, the take-up drive shaft 63, an encoder 122 (see FIG. 4) for detecting the number of rotations of the DC motor 121, and a reduction gear train 65, not shown, for transmitting part of the driving force of the DC motor 121 to each drive shaft, and a chassis 123 for supporting them thereon.

The encoder 122 has a shape of a disc formed with four detection openings along a periphery thereof and is rigidly fixed to an end of the main shaft of the DC motor 121 (in the present embodiment, for explanation purposes, only the portion of the disc except for a rotational speed sensor 141, described hereinafter, is referred to as "the encoder").

The sensor block 14 includes, as shown in FIG. 4, the tape-discriminating sensor 142, the ambient temperature sensor 143 and the head surface temperature sensor 144 as well as the rotational speed sensor 141 for detecting the rotational speed of the DC motor 121. It should be noted that these sensors can be omitted in to suit the actual conditions under which the apparatus is used.

The rotational speed sensor 141 includes a photo sensor, not shown, which faces the detection openings of the encoder 122 and a sensor circuit board for supporting the photo sensor thereon and carries out photoelectric conversion between the same and the photo sensor. The photo sensor has a light-emitting element and a light-receiving element, not shown, arranged in a manner opposed to each other. Light emitted from the light-emitting element passes through the detection openings (arranged along the periphery) of the rotating encoder 122 and is received by the light-receiving element to thereby detect the number of rotations (the number of pulses) of the DC motor 121. In other words, the flickering light from the light-emitting element received by the light-receiving element is photoelectrically converted by the sensor circuit board and output as pulse signals to the control block 200 described hereinafter.

The drive circuit block 270 includes, as shown in FIG. 4, a display driver 271, a head driver 272 and a motor driver 273.

The display driver 271 drives the display 4 of the operating block 11 in response to control signals delivered from the control block 200, i.e. in accordance with commands carried by the signals. Similarly, the head driver 272 drives the thermal head 7 of the printer block 12 in accordance with commands from the control block 200.

Further, the motor driver 273 has a DC motor driver 273*d* for driving the DC motor 121 of the printer block 12 and a cutter motor driver 273*c* for driving the cutter motor 131 of the cutter block 13, and similarly to the display driver 271, drives each motor in accordance with commands from the control block 200.

The operating block 11 includes the keyboard 3 and the display 4. The display 4 has a display screen 41 which is capable of displaying display image data of 96×64 dots in a rectangular display area of approximately 6 cm in the transverse direction (X direction)×4 cm in the longitudinal direction (Y direction). The display 4 is used by the user to enter data via the keyboard 3 to form or edit print image data, such as character string image data, view the resulting data, and enter various commands including ones for selections via the keyboard 3.

On the keyboard 3 there are arranged a character key group 31 including an alphabet key group 311, a symbol key group 312, a number key group 313, and a nonstandard character key group 315 for calling nonstandard characters for selection, neither of which is shown, as well as a function key group 32 for designating various operation modes. In a type of the apparatus which is capable of entering the Japanese language, there is also provided a kana key group 314 for entering Japanese hirakana letters and Japanese katakana letters.

The function key group 32 includes a power key 321, a print key 322 for instructing a printing operation, a selection key 323 for finally determining entry of character data and feeding lines during text entry as well as selecting modes on a selection screen, a color specification key 324 for specifying printing colors and its neutral color (mixed color) of print image data, a color-setting key 325 for setting colors of letters and background colors, and four cursor keys 330 (up arrow key 330U, down arrow key 330D, left arrow key 330L, right arrow key 330R) for moving the cursor or the display range of print image data on the display screen 41 in respective upward "↑", downward "↓", leftward "←", and rightward "→" directions, neither of which is specifically shown.

The function key group 32 also includes a cancel key 326 for canceling instructions, a shift key 327 for use in changing roles of respective keys as well as modifying registered image data, an image key 328 for alternately switching between a text entry screen or a selection screen and an image display screen (image screen) for displaying print image data, a proportion-changing (zoom) key 329 for changing a proportion between the size of print image data and the size of display image data displayed on the image screen, and a style key 341 for setting print formats and styles of labels to be formed.

Similarly to keyboards of the general type, the above key entries may be made by separate keys exclusively provided therefor or by a smaller number of keys operated in combination with the shift key 327 or the like. Here, for purposes of ease of understanding, the following description will be made assuming that there are provided as many keys as described above.

As shown in FIG. 4, from the keyboard 3, various commands described above and data are input to the control block 200.

The control block 200 includes a CPU 210, a ROM 220, a character generator ROM (CG-ROM) 230, a RAM 240, a peripheral control circuit (P-CON) 250, all of which are connected to each other by an internal bus 260.

The ROM 220 has a control program area 221 for storing control programs processed by the CPU 210 and a control data area 222 for storing control data including a letter size table, a letter modification table and the like.

The CG-ROM 230 stores font data, i.e. data defining letters, symbols, figures and the like, provided for the tape printing apparatus 1. When code data for identifying a character or the like is input thereto, it outputs the corresponding font data.

The RAM 240 is supplied with power by a backup circuit, not shown, such that stored data items can be preserved even when the power is turned off by operating the power key 321. The RAM 240 includes areas of a register group 241, a text data area 242 for storing text data of letters or the like entered by the user via the keyboard 3, a displayed image data area 243 for storing image data displayed on the display screen 41, a print image data area 244 for storing print image data, a registered image data area 245 for storing registered image data, as well as a print record data area 246 and a conversion buffer area 247 including a color conversion buffer. The RAM 240 is used as a work area for carrying out the control process.

The P-CON 250 incorporates a logic circuit for complementing the function of the CPU 210 as well as dealing with interface signals for interfacing between the CPU 210 and peripheral circuits. The logic circuit is comprised of a gate array, a custom LSI, etc. For instance, a timer 251 as time-measuring means is also incorporated in the P-CON 250 as a function thereof.

To this end, the P-CON 250 is connected to the sensors of the sensor block 14 and the keyboard 3, for receiving the above-mentioned signals generated by the sensor block 14 as well as commands and data entered via the keyboard 3, and inputting these to the internal bus 260 as they are or after processing them. Further, the P-CON 250 cooperates with the CPU 210 for outputting data and control signals input to the internal bus 260 by the CPU 210 or the like to the drive circuit block 270 as they are or after processing them.

The CPU 210 of the control block 200 receives the signals from the sensor block 14 and the commands and data input via the keyboard 3 by using P-CON 250 according to the control program read from the ROM 220, processes font data from the CG-ROM 230 and various data stored in the RAM 240, and delivers control signals to the drive circuit block 270 via the P-CON 250, to thereby carry out position control during printing operations, the display control of the display screen 41, and the printing control to cause the thermal head 7 to carry out printing on the tape T under predetermined printing conditions. In short, the CPU 210 controls the overall operation of the tape printing apparatus 1.

Next, the overall control process carried out by the tape printing apparatus 1 will be described with reference to FIG. 5. As shown in the figure, when the program for carrying out the control process is started, e.g. when the power of the tape printing apparatus 1 is turned on, first, at step S1, initialization of the system including restoration of saved control flags is carried out to restore the tape printing apparatus 1 to the state it was in before the power was turned off the last time. Then, the image that was displayed on the display screen 41 before the power was turned off the last time is shown as the initial screen at step S2.

Figure 5:
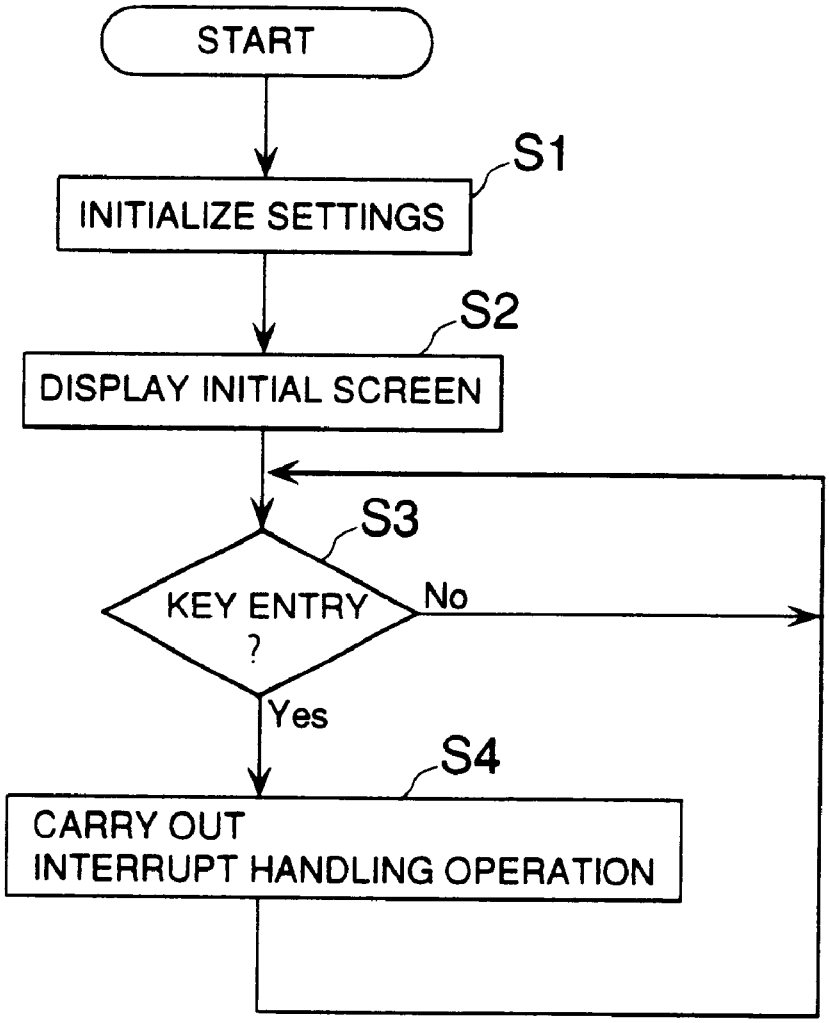
FIG. 5 is a flowchart showing an overall control process executed by the FIG. 1 tape printing apparatus.

The following steps in FIG. 5, that is, step S3 for determining whether or not a key entry has been made and step S4 for carrying out an interrupt handling operation are conceptual representations of actual operations. Actually, when the initial screen has been displayed at step S2, the tape printing apparatus 1 enables an interrupt by key entry (keyboard interrupt), and maintains the key entry wait state (No to S3) until a keyboard interrupt is generated. When the keyboard interrupt is generated (Yes to S3), a corresponding interrupt handling routine is executed at step S4, and after the interrupt handling routine is terminated, the key entry wait state is again enabled and maintained (No to S3).

As described above, in the tape printing apparatus 1, main processing operations executed by the apparatus are carried out by task interrupt handling routines, and hence if print image data required to be printed is provided or has been prepared, the user can print the image data at a desired time, by depressing the print key 322 to generate an interrupt handling routine and thereby start a printing process for carrying out a printing operation. In short, operating procedures up to the printing operation can be selectively carried out by the user as he desires.

Figure 6:
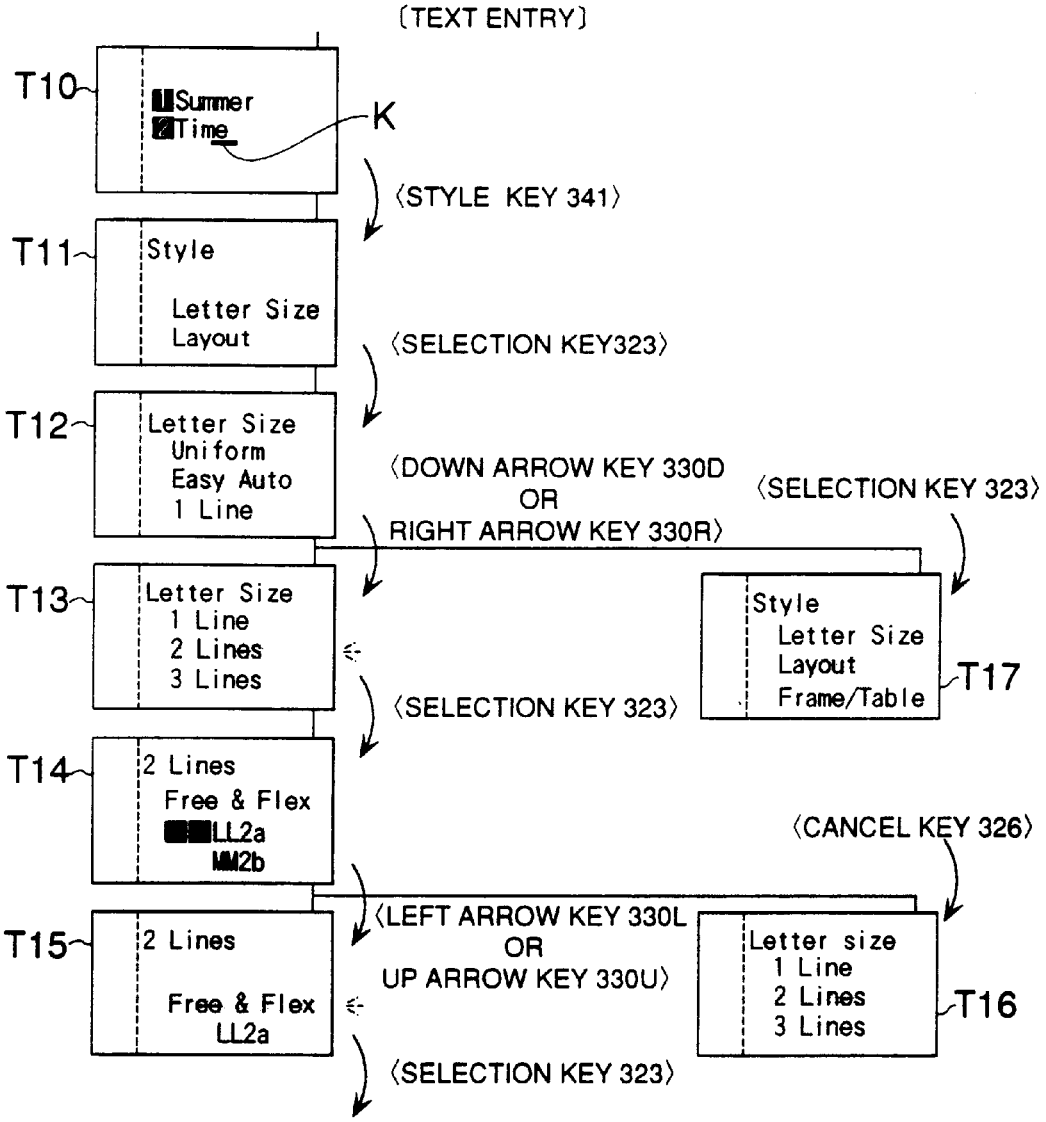
FIG. 6 shows screen images displayed on a display screen of a liquid crystal display, which are useful in explaining a first half of a procedure of selecting and setting letter sizes.

First, a procedure for selecting and setting a letter size will be described with reference to FIGS. 6 to 8. As shown in FIG. 6, if the style key 341 is depressed when a text entry screen is displayed (screen T10: hereinafter, contents displayed on the display screen 41 are referred to as "the screen T??" (? represents a digit) and the reference numerals for the screens are shown only by T??), it becomes possible to select from print format/style options (T11).

More specifically, one of three print format/style options of (1) "Letter Size", (2) "Layout", (3) "Frame/Table" can be selected by operating the down arrow key 330D (or the right arrow key 330R) or the up arrow key 330U (or the left arrow key 330L) to display the same in reverse video (in the illustrated example, expressed by shading of character images by dots), and then by depressing the selection key 323, it is possible to designate the option displayed in reverse video.

As shown in FIG. 6, immediately after depressing the style key 341, the default option of (1) "Letter Size" is displayed in reverse video and hence if the selection key 323 is depressed in this state (T11), the option (1) "Letter Size" is selected, thereby enabling letter size-setting methods to be selected (T12).

Figure 17A:
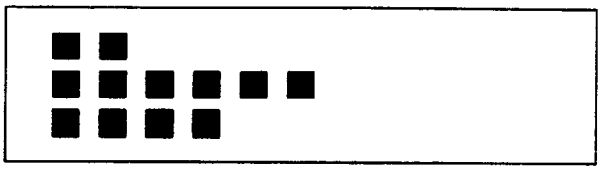
FIG. 17A PRIOR ART
FIGS. 17A to 17C are diagrams schematically showing images representative of sizes and layout of printed letters obtained by a conventional tape printing apparatus.
Figure 17B:
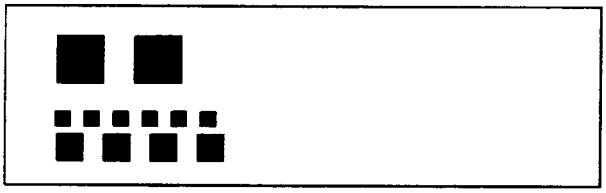
FIG. 17B PRIOR ART
Figure 17C:
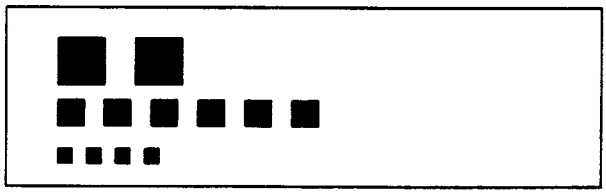
FIG. 17C PRIOR ART

One of the letter size-setting methods can be selected by designating options from menus represented by a table in FIG. 7, i.e. a menu provided at level 2 under the option (1) "Letter Size" selected at level 1, which is formed of an option (1) "Uniform" corresponding to the "Uniform Character Size Mode" described hereinabove under the heading of Prior Art with reference to FIGS. 17A to 17C, an option (2) "Easy Auto" corresponding to the "Leave-it-to-apparatus Mode" of the prior art, and options (3) "# Line(s)" (# represents the number of lines to be printed in each individual option) which correspond to "Character Size Menu Mode" of the prior art and "Character Size Free Mode" as an improved mode of the "Character Size Menu Mode", and a menu and an option provided at level 3 under each of the options (3) "# Line(s)", i.e. a menu (1) corresponding to "Character Size Menu Mode" and an option (2) "Free & Flex" corresponding to the "Character Size Free Mode".

For instance, from a state where the menu of (1) "Letter Size" is displayed in FIG. 6 (T12), when the down arrow key 330D (or the right arrow key 330R) or the up arrow key 330U (or the left arrow key 330L) is operated to place the cursor on an option of "2 Lines" of the (3) "# Line(s)" options to display the same in reverse video (T13), and then the selection key 323 is depressed, a menu at level 3 is displayed (T14). Similarly to the above operations, after selecting the option (2) "Free & Flex" to display it in reverse video (T15), by depressing the selection key 323, an entry screen for a free and flexible mode is displayed (the rest is omitted). When the cancel key 326 is depressed in the state of the screen T14, the display screen returns to one for the upper level 2 (T16).

When letter sizes are set to each line by selecting from menus and letter size ranks under the option of "Free & Flex" and then the selection key 323 is depressed, the screen returns to level 1 (T16). Further, when the selection key 323 is depressed in the state of the option (2) "Easy Auto" being displayed in reverse video (T12), an "Easy Auto" mode is set and similarly the screen returns to level 1 (T17).

Figure 8:
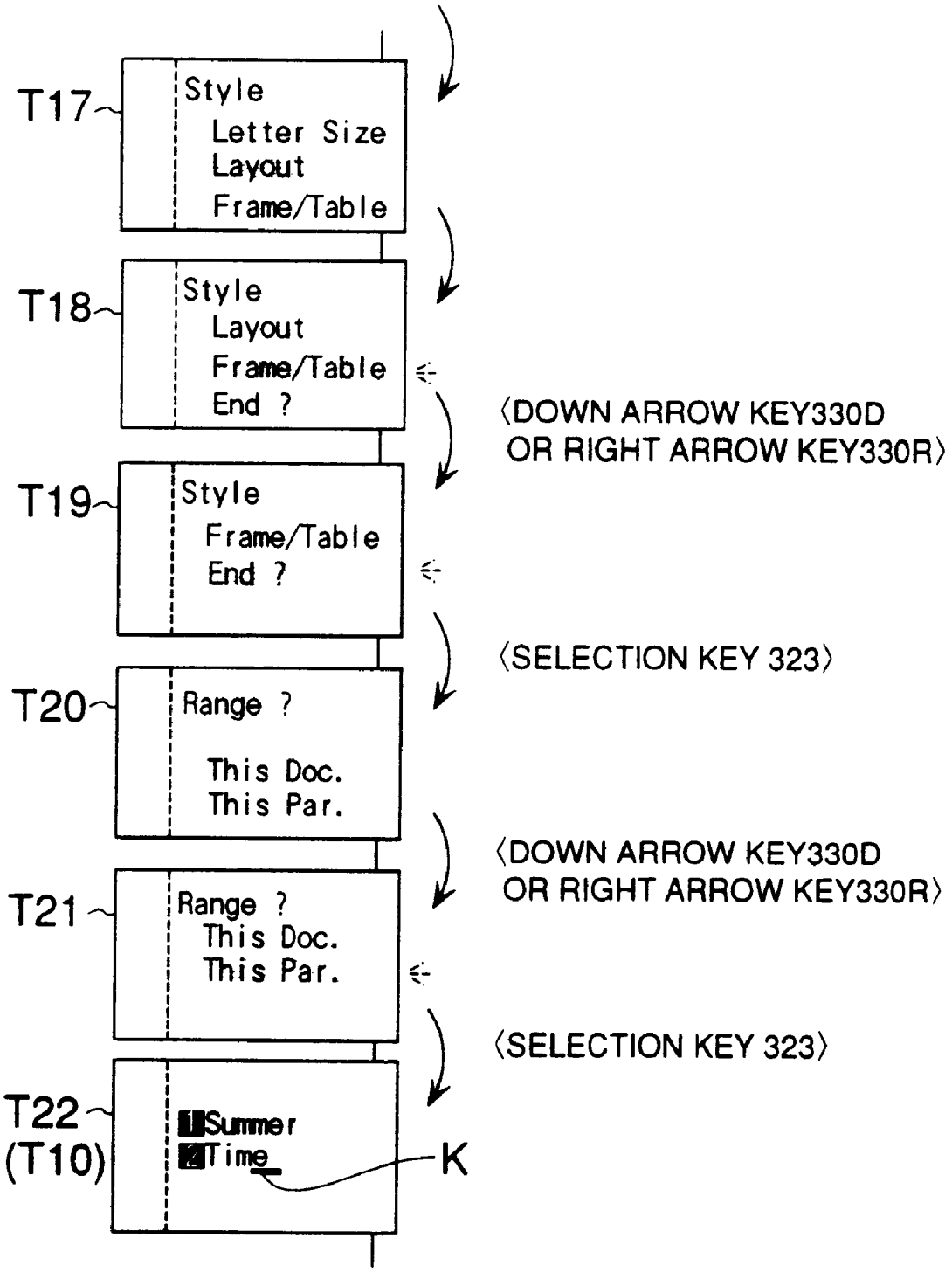
FIG. 8, which is a continuation of FIG. 6, shows screen images which are useful in explaining a second half of the procedure of selecting and setting letter sizes.

Referring to FIG. 8, in the above-described selection (T17: commonly shown in FIG. 7), when the down arrow key 330D or the right arrow key 330R is depressed, the option (3) "Frame/Table" is selected to display the same in reverse video (T18). Further, when the same operation is carried out, an option "End ?" is displayed in reverse video (T19).

When the selection key 323 is depressed in the above state (T19), a message screen (T20 to T21) appears which requests an entry of an effective area from a menu of options, such as "This Doc." and "This Par.". For instance, if the option "This Par." is displayed in reverse video (for designation) and the selection key 323 is depressed, the settings of print formats and styles including letter sizes to the two lines are completed, followed by returning to the text entry screen (T22: the same as T10 shown in FIG. 7).

In this case, a letter size (mode for calculation thereof) is set to a paragraph in which the cursor K is positioned, and the screen returns to the text entry screen, while the tape printing apparatus 1 (the control block 200 thereof) calculates the letter size according to the set or determined mode for forming a corresponding print image.

Next, a procedure of selecting and setting a fixed length layout or an arbitrary length layout and a procedure of selecting and setting a layout style of a print image comprised of character string images and the like in the selected layout type will be described.

Figure 9:
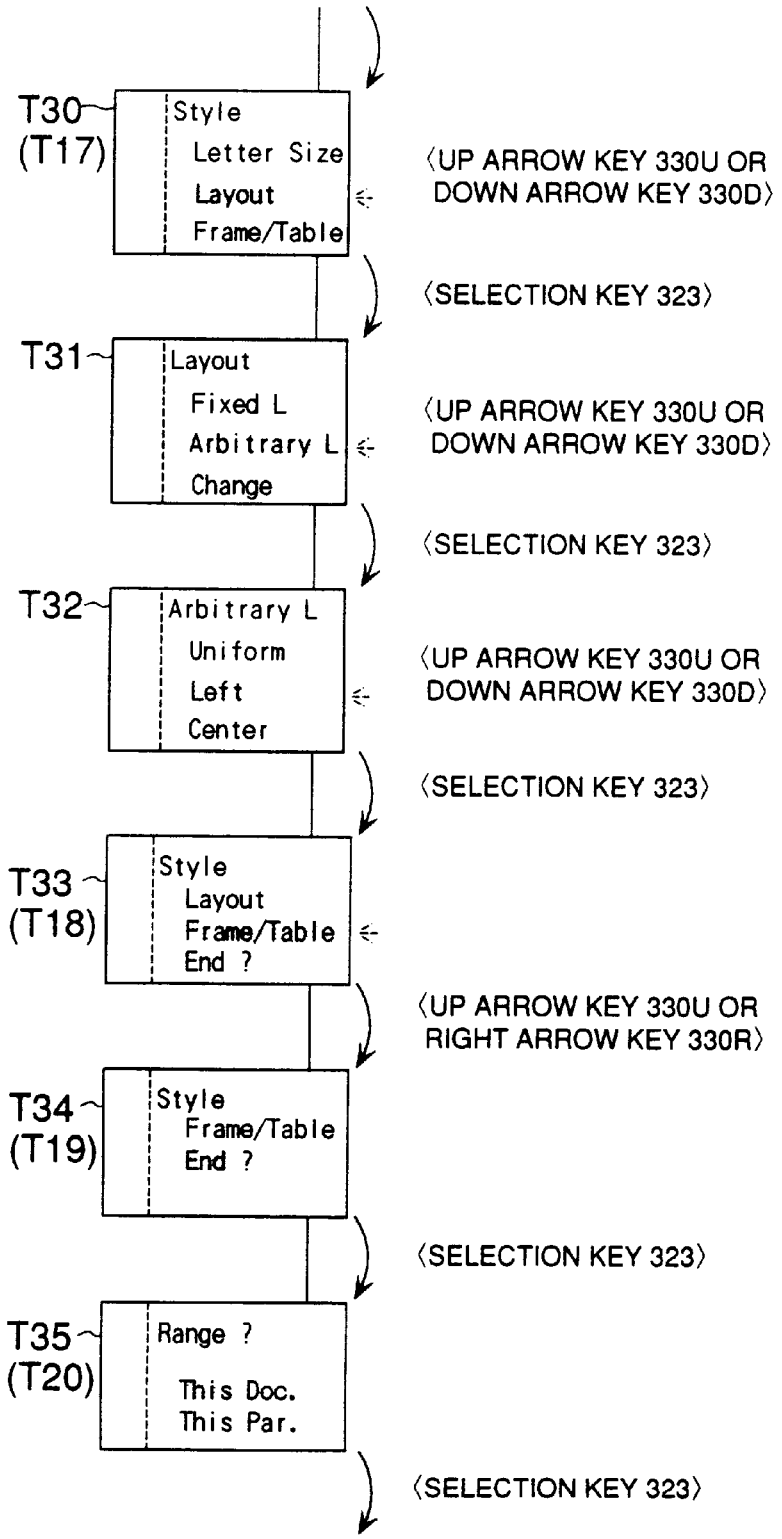
FIG. 9, which is similar to FIG. 6, shows screen images which are useful in explaining a procedure of selecting and setting a layout style in an arbitrary length layout process.

Let it be assumed, for instance, that in the state described above with reference to FIG. 6 (T10), that is, in the state of the text entry screen being displayed, the style key 341 is similarly depressed, and then in the state of a selection screen for selecting a print format/style (T11), as shown in FIG. 9, the option (2) "Layout" for carrying out a layout process is selected to display the same in reverse video (T30: identical to T17 in FIGS. 6 and 8). If the selection key 323 is depressed in this state, a selection screen (T31) is displayed, which prompts the user to select from the options of "Fixed L" (Fixed Length, "Arbitrary L" (Arbitrary Length) and "Change", for setting a layout style.

Since the fixed length layout-selecting/setting procedure will be described later, the arbitrary length layout-selecting/setting procedure will be described first in the following.

In the above-described selection (T30), after displaying the option "Arbitrary L" in reverse video (T31), by depressing the selection key 323, a selection screen (T32) for selecting a layout style for the arbitrary length layout process is displayed.

In the above state (T32), it is possible to select any of the options of (1) "Uniform" which designates uniform layout for arranging character images of each character string image at equal space intervals, (2) "Left" which designates left alignment for aligning the left end of each character string image with the left end of a selected range, (3) "Right" which designates right alignment for aligning the right end of each character string image with the right end of the selected range, (4) "Center" which designates center alignment for aligning the center of each character string image with the center of the selected range, and (5) "Scale Up/Down" which designates scale up/down processing for expanding or reducing the size of each character image such that the length of the character string image is adapted to the selected range.

In the illustrated example, after the option (2) "Left" is displayed in reverse video (T32), the selection key 323 is depressed to return to the above selection screen for selecting a print format/style (T33: identical to T18 in FIG. 8). In this state (T33), when the option "End ?" is displayed in reverse video (T34: identical to T19) in the same manner as described above, if the selection key 323 is depressed, a message screen (T35: identical to T20) appears which requests an entry of an effective area from a menu of options, such as "This Doc." and "This Par.". For instance, if the selection key 323 is depressed when the option "This Doc." is displayed in reverse video, the print format/style-selecting/setting process is completed, followed by returning to the text entry screen (the same screen as T22 in FIG. 8).

Simultaneously when the screen returns to the text entry screen, not a paragraph having the cursor K positioned therein but the whole writing, that is, the whole print image is set to the arbitrary length, and hence the above print image formed according to the letter size-setting mode or the like is preserved as it is.

Next, the fixed length layout-selecting/setting procedure will be described.

As described hereinabove with reference to FIG. 6, immediately after depressing the style key 341, the default option (1) "Letter Size" is displayed in reverse video (T11 in FIG. 6). If the option "Layout" is selected to be displayed in reverse video (T30 in FIG. 9) instead of the option (1) "Letter Size" and then the selection key 323 is depressed, the selection screen is displayed, which prompts the user to select from the options "Fixed L", "Arbitrary L" and "Change" for the layout process (T31 in FIG. 9).

Figure 10:
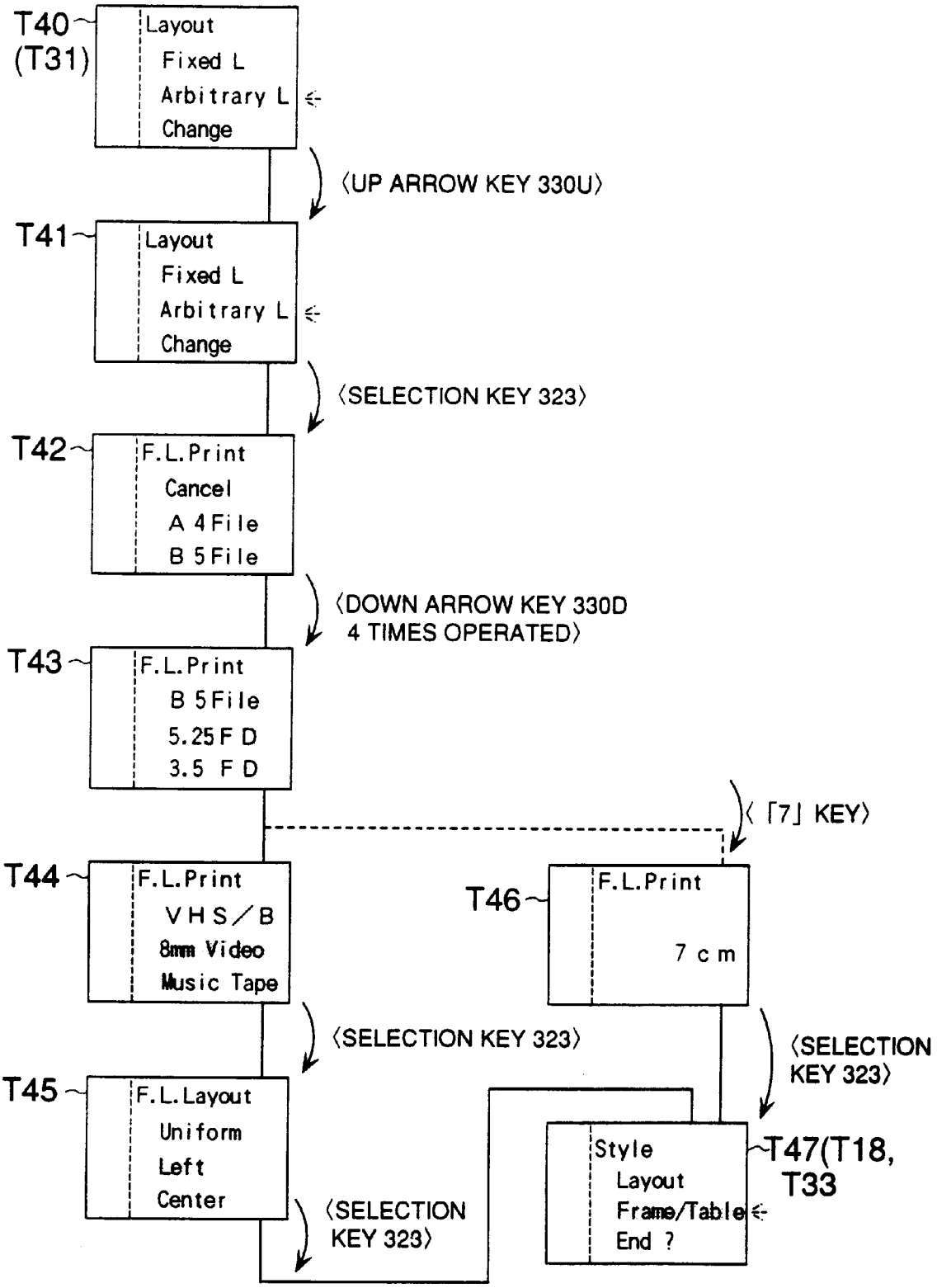
FIG. 10, which is similar to FIG. 6, shows screen images which are useful in explaining a procedure of selecting and setting a layout style in a fixed length layout process.

Referring now to FIG. 10, if the up arrow key 330U is operated from the above state (T40: identical to T31 in FIG. 9) to display the option "Fixed L" in reverse video (T41) and the selection key 323 is depressed, differently from the above case where the option "Arbitrary L" is selected, a selection screen for setting the fixed length is displayed (T42).

From the above state (T42), it is possible to select any of options of (1) "Cancel" for canceling execution of the setting of a fixed length, (2) "A4 File" for designating the width of a label for use in an A4 file, as a length defining the fixed format (in the present embodiment, this label is assumed to have a width of 20 cm), (3) "B5 File" for similarly designating the width of a label for use in a B5 file (15 cm), (4) "5.25 FD" for designating the width of a label for use in a 5.25 floppy disk (8.5 cm), (5) "3.5 FD" for designating the width of a label for use in a 3.5 floppy disk (6.5 cm), (6) "VHS/β" for designating the width of a label for use in a VHS/β video tape cassette (14 cm), (7) "8 mm Video" for designating the width of a label for use in an 8 mm video tape cassette (7 cm), (8) "Music Tape" for designating the width of a label for use in a music tape (9.5 cm), etc. (T42 to T44).

In the illustrated example, the option "8 mm Video" is displayed in reverse video (T44) and the selection key 323 is depressed to display a selection screen which prompts the user to select a layout style (fixed length layout) (T45).

It should be noted that the tape printing apparatus 1 is capable of not only selecting a length adapted to a fixed format, as described above, but also setting an arbitrary length e.g. "7 cm" to the fixed length (T46) by operating a desired number key (for instance, "7" key) of the number key group 313 on the keyboard 3, when the selection screen for selecting the fixed length layout is displayed (T42 to T44).

The layout style-setting process and processes subsequent thereto (screens subsequent to T47: identical to those subsequent to T18 in FIG. 8 and those subsequent to T33 in FIG. 9) are carried out similarly to the case of the above arbitrary length layout process, and therefore detailed description thereof will be omitted. In the tape printing apparatus 1, if the fixed length is set, the screen returns to the text entry screen (identical to T22 in FIG. 8), while a fixed length-setting interrupt handling routine is generated to activate fixed length printing process shown in FIG. 11, and a size of each paragraph (each elementary image) of a print image is adjusted (reduced) for layout, such that the length (value of a print length) of the print image having paragraphs each comprised of character images and the like is set to the length (value set as a fixed length) of a range of its fixed length.

In the following, the fixed length printing process will be described with reference to FIG. 11, while outlines and examples thereof are given with reference to FIGS. 12A to 15G. In the following, a print image data item is referred to as "G??", a print image formed by printing the print image data item G?? on the tape T is referred to as "M??", and a label image of a label created by cutting off the tape T is referred to as "R??". They are indicated in FIG. 12A et seq. by the same reference numerals, and when they are produced based on the same print image data item, they are simply referred to as "G?? (M??, R??)".

As shown in FIGS. 12A to 12C, it is assumed that there is provided a print image data item G10 comprised of five paragraphs, in which e.g. a first, a third and a fifth paragraph ((1), (2) and (3)) paragraphs displayed as "EASY AUTO PAR." in the figures), are set to the mode of "Easy Auto" corresponding to the "Leave-it-to-apparatus Mode" described above with reference to FIG. 17B, while a second and a fourth paragraph (displayed as "NON-EASY AUTO PAR.") other that the above three paragraphs are set to another letter size-setting mode. First, when the print image data item G10 is to be reduced according to a value set as a fixed length, in the illustrated example, the paragraphs ("EASY AUTO PAR.") set to the "Easy Auto" mode are handled as variable-sized paragraphs (variable-sized elementary images) and the other paragraphs are handled as fixed-sized paragraphs (fixed-sized elementary images).

Since the "Easy Auto" mode corresponds to the so-called "Leave-it-to-apparatus Mode", "EASY AUTO PAR." can be regarded as paragraphs only required to be arranged with a neat appearance, that is, paragraphs having the user's intention less reflected on the current arrangement of letters or the like thereof than any other paragraph set to the other mode.

Therefore, e.g. when the user desires to form labels with portions to be printed with titles of videos or the like such that the portions are identical in size by the use of the tape printing apparatus 1 and store a plurality of videos having the labels affixed thereto side by side, it is difficult to assume that the user sets the "Easy Auto" mode for leaving the setting of a letter size to the tape printing apparatus 1, to paragraphs including titles of videos.

Inversely, it is assumed, for instance, that the user sets another letter size-setting mode to important paragraphs to be printed with titles of videos, whereas the user is expected to set the "Easy Auto" mode to paragraphs to be printed with information, such as dates or the like, only required to be read or recognized after printing, since it is troublesome to set a letter size to the paragraphs.

Although paragraphs set to letter size-setting modes other than the "Easy Auto" mode can be handled as variable-sized paragraphs, in the following description, paragraphs ("EASY AUTO PAR.") set to the "Easy Auto" mode are handled as variable-sized paragraphs (variable-sized elementary images) and paragraphs ("NON-EASY AUTO PAR.") set to the other modes are handled as fixed-sized paragraphs (fixed-sized elementary images).

Figure 11:
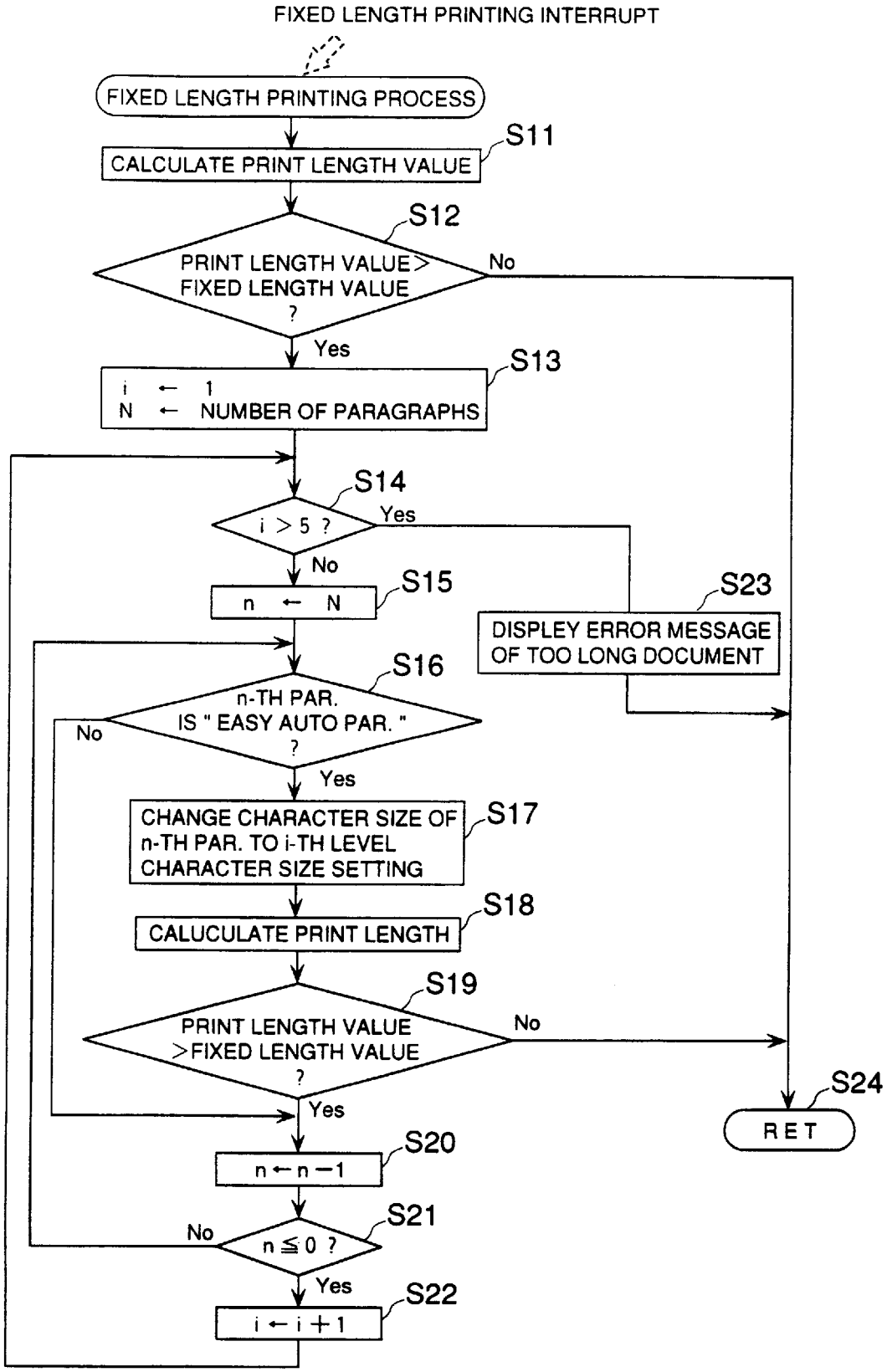
FIG. 11 is a flowchart showing, by way of example, the fixed length layout process.

When the fixed length is set and the display screen returns to the text entry screen, the fixed length-setting interrupt handling routine is simultaneously generated to start the fixed length printing process shown in FIG. 11. First, a length (value of a print length) required for printing a basic image formed by the user, that is, a length required for printing the basic image as it is when no fixed length is set (i.e. when the basic image has an arbitrary length) or when the basic image is contained in the range of the fixed length set therefor, (hereinafter this length is referred to as the "print length in the arbitrary length layout") is calculated at step S11 and the calculated length is compared with a value set as the fixed length at step S12.

Figures 14A, 14B, 14C, 14D, 14E, 14F, 14G, 14H:
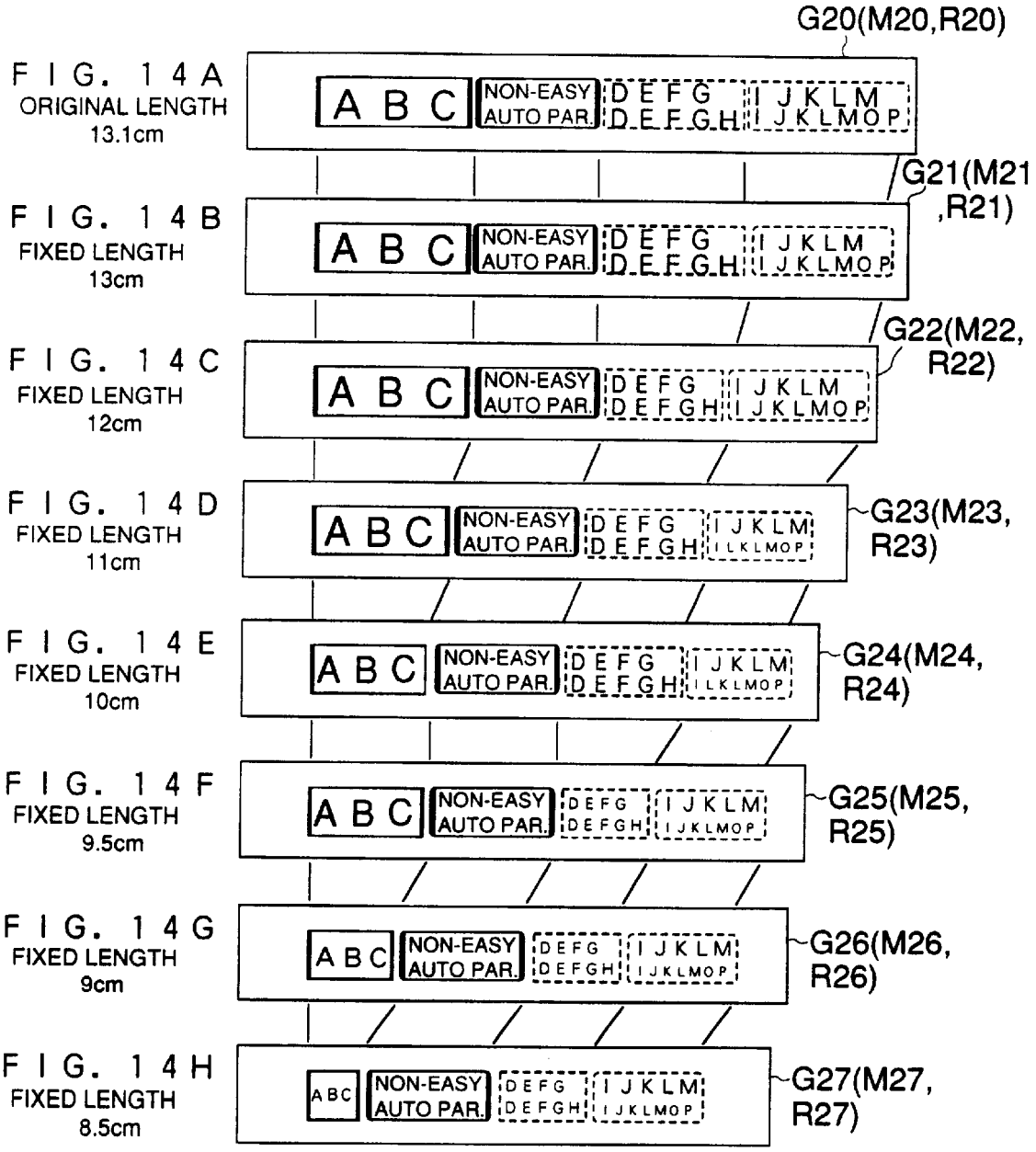
FIGS. 14A to 14H are diagrams each showing, by way of example, image data items processed by the fixed length layout process.
Figures 15A, 15B, 15C, 15D, 15E, 15F, 15G:
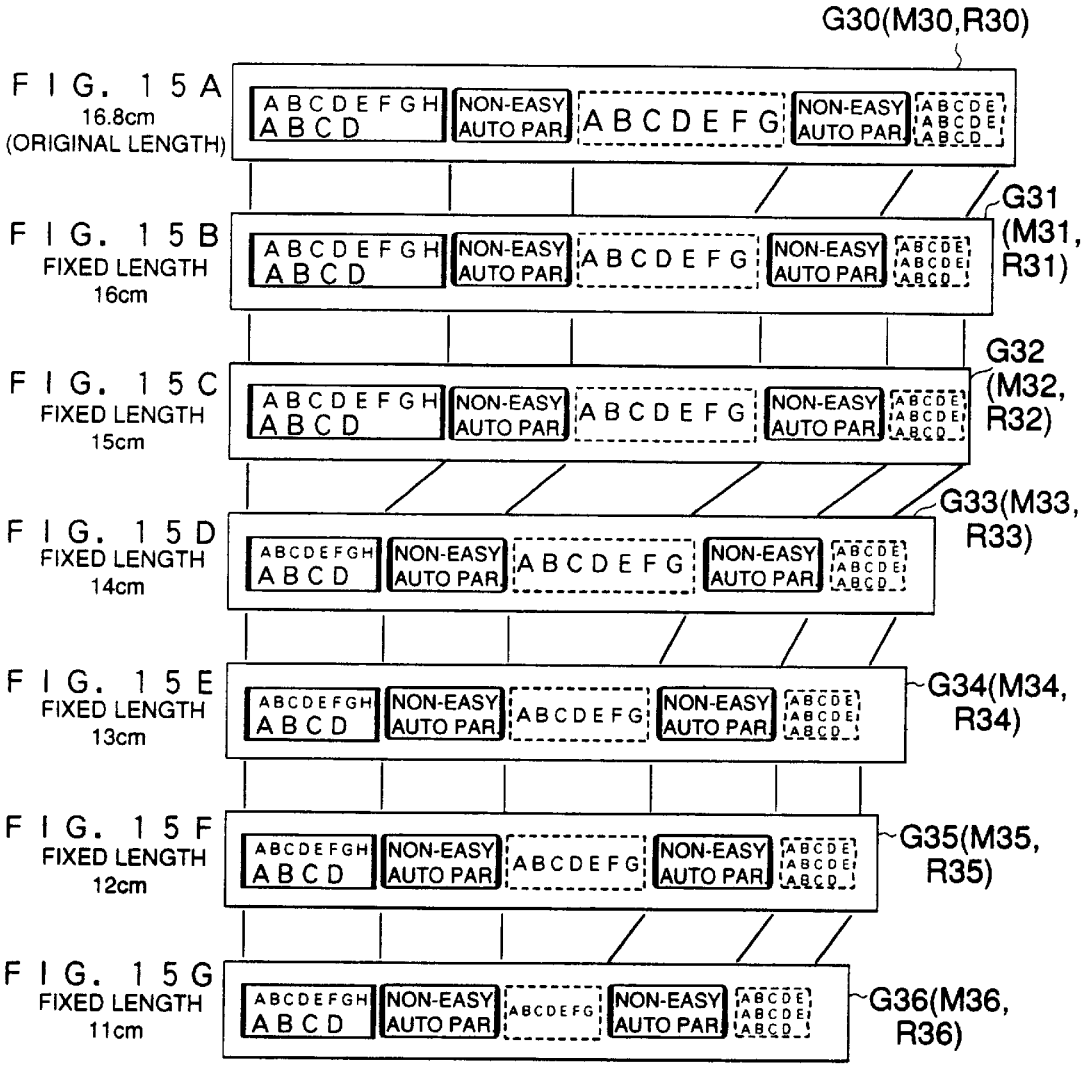
FIGS. 15A to 15G, which are similar to FIGS. 14A to 14H, each show, by way of example, other image data items processed by the fixed length layout process.

For instance, FIG. 14A shows an example of a print image in which the print length in the arbitrary length layout=13.1 cm, and the number of paragraphs N=4, and FIG. 15A shows an example of a print image in which the print length in the arbitrary length layout=16.8 cm, and the number of paragraphs N=5, while FIGS. 14B to 14H and FIGS. 15B to 15G show examples of the FIG. 14A print image and the FIG. 15A print image subjected to fixed length layout processing respectively. In the cases of the above examples, at the step S11, values of print lengths are calculated to obtain 13.1 (cm) and 16.8 (cm) respectively.

The value of the print length of the basic image in the arbitrary length layout, that is, the value of an original print length of the basic image obtained immediately after producing the same is compared with a value set as the fixed length at step S12. If the value of the above print length is equal to or smaller than that set as the fixed length (No to S12), the basic image fits within a predetermined printing area even if printed as it is, and hence the fixed length printing process is terminated at step S24. Thereafter, the user depresses the print key 322 at any given time, whereby the basic image (for instance, a FIG. 14A print image data G20 (M20, R20) or a FIG. 15A print image data G30 (M30, R30)) can be printed as it is as a print image.

On the other hand, when the basic image has a print length thereof larger than the value set as the fixed length (Yes to S12), next, variables i and N are initialized (to i=1, N=the number of paragraphs) at step S13. For instance, if a basic image (the print image data item G10) appearing in FIG. 12 has a print length thereof larger than the value set as the fixed length (Yes to S12), next, the variables i and N are initialized (to i=1, N=5) at step S13.

After initialization of the variables i and N, it is determined at step S14 whether or not the basic image has been reduced through a predetermined number of levels (in the illustrated example, the predetermined number is defined as 5).

Now, when the reduction of the basic image has been effected through the predetermined number of levels, i.e. although the basic image has been reduced to level 5 through the predetermined number of levels (see FIG. 13), when the basic image has the value of the print length thereof still larger than the value set as the fixed length (Yes to S14), the user is notified that the basic image cannot be printed in a set or determined fixed length layout range (that is, a desired printing area), by an error message of "Too Long Doc." displayed on the display screen 41 of the display 4 at step S23, followed by terminating the process at step S24.

On the other hand, when the reduction of the basic image has not yet reached level 5 (No to S14), the number N (for instance, N=5 in the FIG. 12 example) of paragraphs is assigned to a variable n at step S15. Then, it is determined at step S16 whether or not an n-th paragraph (the fifth paragraph) belongs to the "EASY AUTO PAR.".

In the FIG. 12 example, the fifth paragraph is an "EASY AUTO PAR." ((3) of G10), as described above. In such a case (Yes to S16), next, at step S17, the character size of the paragraph is changed to one at level i (at first i=1).

As shown in FIG. 13, in the tape printing apparatus 1, the character size of a basic image is used as a basic character size to define the character size of a print image reduced at level i (i=1 to 5).

It should be noted that the term "character" of the character size mentioned in this embodiment is intended to include not only letters, numerals, symbols and simple figures but also slightly complicated figures and the like registered as nonstandard characters or images, and character images are used to mean images comprised of characters defined as above which are developed into dot matrices.

In short, the scale-down processing (S17) is capable of reducing the size of each "EASY AUTO PAR." as a variable-sized paragraph (variable-sized elementary image) by reducing the size of each character image.

In the case of the FIG. 12 example, the fifth paragraph is an "EASY AUTO PAR." ((3) of G10), as described above, and hence the scale-down processing is carried out, whereby the character size of the fifth paragraph is first changed to one at level i, that is, at first, to one at level i (i=1) shown in FIG. 13 at step S17.

It should be noted that printing apparatuses other than the tape printing apparatus 1 as well normally have a plurality of sizes of character images. In such printing apparatuses, the character sizes thereof are changed, thereby enabling the scale-down processing to be easily carried out.

Further, in the tape printing apparatus 1, when an "EASY AUTO PAR." as a variable-sized paragraph (variable-sized elementary image) includes a plurality of lines, the lines of the paragraph are reduced in size in a manner such that they hold a relatively identical line size ratio to each other.

For instance, when the paragraph has two lines, that is, a first line having an M size and a second line having an S size (see a box containing M+S in the figure), the first line is set to a reduced M size, while the second line is set to a reduced S size (see a box containing RM (Reduced M)+RS (Reduced S) in the figure), thereby reducing the lines at a ratio identical to an original line size ratio M/S (i.e. M/S=RM/RS).

In other words, according to the tape printing apparatus 1, a variable-sized paragraph (variable-sized elementary image) having a plurality of lines is reduced in size in a manner such that character images on the plurality of lines maintain an identical character image size proportion between them. Therefore, the variable-sized paragraph (the variable-sized elementary image) can be reduced in size without changing appearances of the lines relative to each other, whereby it is possible to reflect on a print image the user's intention, that is, the relationship in size between the character images which the user set (desired) in forming the basic image.

It should be noted that although in the above examples, description has been made of only reduction in size of character images, this is not limitative, but when there are blanks (blank images other than character images) between character images in a variable-sized paragraph (variable-sized elementary image), it is possible to reduce only the blank images as to the paragraph to thereby carry out the scale-down processing with ease. Further, the blank images may be reduced along with sizes of character images.

Furthermore, similarly, when a variable-sized paragraph (variable-sized elementary image) has marginal blank images forward and backward of each character image, it is possible to easily effect the scale-down processing on the variable-sized paragraph (the variable-sized elementary image), simply by reducing the marginal blank images in the variable-sized paragraph (the variable-sized elementary image). Of course, these marginal blank images can be reduced with the above sizes of character images or blank images between character images.

After completing the above scale-down processing at S17, a value of the print length of a reduced image at the step of the operating procedure is calculated at step S18. At this time point, in the above FIG. 12 example, for instance, the fifth paragraph as the "EASY AUTO PAR." ((3) of G10) has the character size thereof changed to that at level 1 (S17) to reduce the same in size ((3)of G11).

Next, the value of the print length and the value set as the fixed length are compared with each other at step S19. If the value of the print length is equal to or smaller than the value set as the fixed length (No to S19), when the reduced image at this time point (for instance, the FIG. 12 print image data G11) is printed as a print image, the printed image can be contained in the predetermined printing area, and hence the fixed length printing process is terminated at step S24.

Thereafter, as described hereinabove, the user depresses the print key 322 at any given time, whereby the reduced image can be printed as a print image in the printing area.

On the other hand, when the value of the print length is larger than the value set as the fixed length (Yes to S19), next, the variable n is updated (decremented: n←n−1) at step S20 and it is determined at step S21 whether or not the variable n becomes equal to 0, that is, whether or not the scale-down processing has been carried out on all the paragraphs. If the scale-down processing is not carried out on all the paragraphs (No to S21), it is determined at step S16 whether or not a new n-th paragraph is an "EASY AUTO PAR.", that is, whether or not the n-th paragraph is a variable-sized paragraph (variable-sized elementary image).

At this time point, in the above FIG. 12 example, for instance, by updating the variable n (n=5−1=4), a fourth paragraph is set to the new n-th paragraph at step S20, which is a "NON-EASY AUTO PAR." (paragraph between (2) and (3) of G11). In such a case (No to S16), the scale-down processing is not carried out, and the variable n is again updated (n=4−1=3) at step S20. Then, it is determined at step S21 whether or not the variable n has been updated to cover all the paragraphs (i.e. whether or not n≦0 holds). If the scale-down processing is not carried out on all the paragraphs (No to S21), it is determined at step S16 whether or not a new n-th paragraph (third paragraph) is an "EASY AUTO PAR.", i.e. a variable-sized paragraph (variable-sized elementary image).

Since the FIG. 12 third paragraph required to be processed at this time point is an "EASY AUTO PAR." ((2) of G11), similarly to the case of the above fifth paragraph, the scale-down processing for changing the character size of the third paragraph to that at level 1 (see FIG. 13) is executed at step 17, and a value of the print length of a reduced image (G12 appearing in FIG. 12) at this time point is calculated at step S18. If the value of the print length is equal to or smaller than the value set as the fixed length (No to S19), when the reduced image (G12) is printed as a print image, the printed image can be contained in the predetermined printing area, and hence the fixed length printing process is terminated at step S24.

On the other hand, when the value of the print length is larger than the value set as the fixed length (Yes to S19), the variable n is updated (n=3−1=2) at step S20 and it is determined at step S21 whether or not the variable n has been updated to cover all the paragraphs (i.e. whether or not n≦0 holds).

During execution of the above loop for the scale-down processing (S16 to S21), if the print length of a reduced image becomes equal to or smaller than the value set as the fixed length (No to S19) before or when the variable n is updated (n=5, 4, 3, 2, 1) for all the paragraphs (n≦0) (Yes to S21), the reduced image (G12) printed as a print image fits within the predetermined printing area, and hence the fixed length printing process is terminated at step S24.

Thereafter, as described above, the user depresses the print key 322 at any given time, whereby the reduced image can be printed as a print image in the printing area.

In general, in tape printing apparatuses, one organized portion of writing and the like (including numerals, symbols and simple figures as well as slightly complicated figures or the like registered as nonstandard characters) is compiled as one paragraph, so that contents (aims) expressed by images in paragraphs and degrees of importance of the paragraphs are different from each other.

As described above, in the tape printing apparatus 1, each of a plurality of elementary images constituting an original basic image (for instance, print image data G10) created by the user corresponds to one of a plurality of paragraphs to be printed on the tape T, and hence if the basic image is created such that images in the paragraphs are distinguished from each other according to their importance, and if settings of each paragraph are carried out according to a degree of importance of the paragraph, when the basic image is reduced in size to form a print image as well, the aim or degree of importance of each paragraph is reflected on the print image. This makes it possible to clearly reflect the user's intention which he had in forming the basic image.

As a result, when the user desires to form labels having portions printed with titles of videos or the like such that the portions are identical in size by using the tape printing apparatus 1 and store a plurality of videos with the labels affixed thereto side by side, for instance, the user sets a letter size-setting mode other than the "Easy Auto" mode to the important paragraphs to be printed with the titles of videos, thereby uniformly forming the paragraphs as fixed-sized ones, while setting the "Easy Auto" mode to paragraphs to be printed with information, such as dates or the like, thereby forming the paragraphs as variable-sized ones. This enables the user to form a print image having his intention reflected thereon, and print the print image to thereby create desired labels (for instance, labels having portions printed with titles of videos such that the portions are identical in size to each other).

On the other hand, when the above loop is carried out for executing the scale-down processing (S16 to S21), if the print length of a reduced image becomes larger than the value set as the fixed length (Yes to S19) when the variable n is updated (n=5, 4, 3, 2, 1) for all paragraphs (n≦0) (Yes to S21), then, the variable i is updated (incremented: i←i−1) at step S22, and again it is determined at step S14 whether or not the scale-down processing has reached level 5 (the predetermined level number).

Here, if the scale-down processing has not reached the predetermined level 5 (No to S14), the number of paragraphs N (for instance, N=5 in the FIG. 12 example) is assigned to the variable n at step S15, and at steps S16 to S21, the scale-down processing is carried out by executing the loop which is started from determination whether or not the next n-th paragraph (the fifth paragraph) is an "EASY AUTO PAR.".

In the above process, a basic size to be referred to in FIG. 13 is a size at level 2 (2=i=1+1). If the print length of the above reduced images formed after the variable n is updated to cover all the paragraphs is larger than the one set as the fixed length (Yes to S19), the variable i is further updated (i=2+1=3) at step S22 to carry out the same loop (S14 to S22).

The variable i is updated (i=1, 2, 3, 4, 5) to carry out the above loop (S14 to S22), and if the print length of a reduced image formed before or when the scale-down processing has reached the predetermined level 5 (see FIG. 13) (Yes to S14) becomes equal to or smaller than the value set as the fixed length (No to S19), if the reduced image to be printed as a print image fits within the predetermined printing area, and hence the fixed length printing process is terminated at step S24.

Thereafter, as described hereinbefore, the user depresses the print key 322 at any given time, whereby the reduced image can be printed as the print image in the printing area.

As described above, according to the tape printing apparatus 1, scale-down processing for reducing each variable-sized paragraph (each variable-sized elementary image) comprises scale-down processing for reducing the same through a plurality of predetermined levels. Therefore, it is possible to progressively reduce each variable-sized paragraph (each variable-sized elementary image), thereby obtaining a plurality of images stepwise reduced.

Further, in the tape printing apparatus 1, when the print length of an image progressively reduced (reduced stepwise through a plurality of levels) is equal to or smaller than the value set as the fixed length (No to S19), the fixed length printing process is terminated at step S24. In other words, if the basic image is reduced stepwise through a plurality of levels, a plurality of reduced images can be obtained, and out of the reduced images printable in the printing area, one having the largest size comes to be selected as the print image. This makes it possible to cause a selected print image to have the largest size of all print images printable in the printing area, thereby permitting a large and attractive print image to be formed.

On the other hand, although the variable i is updated (i=1, 2, 3, 4, 5) and the scale-down processing has been carried out up to the predetermined level 5 (see FIG. 13), when the print length of the reduced image is still larger than the value set as the fixed length (Yes to S14), the user is notified that the reduced image cannot be printed in a set or determined fixed length layout range (that is, a desired printing area) by displaying the error message of "Too Long Doc." on the display screen 41 of the display 4 at step S23, followed by terminating the fixed length printing process at step S24.

That is, in the tape printing apparatus 1, if a reduced image having the smallest size of all images reduced stepwise through a plurality of levels cannot be printed within the printing area, the user is notified of the fact, so that he can recognize that even the reduced image having the smallest size cannot be printed in the printing area. This enable the user to change basic images or letter size-setting modes, thereby coping with an undesired layout or a disabled printing operation more quickly. That is, the user can cope with an undesired layout or a disabled printing operation by changing characteristics of sizes set to elementary images, when it is determined that a print image is not laid out as desired or cannot be printed within the printing area.

Further, according to the tape printing apparatus 1, even when variable-sized paragraphs (variable-sized elementary images) are each reduced in size (scaled down) at level 1, the basic image can be reduced through levels corresponding in number to the number of the paragraphs (the three of (3) to (1) in the FIG. 12 example) (e.g. such that G10→G11→G12→ . . . , as shown in FIG. 12), so that reduced images identical in number to the number of reduction steps can be made candidates one after another, thereby enabling delicate or accurate scale-down processing to be carried out. This makes it possible to form a print image more suitable for the printing area therefor.

It should be noted that as an alternative to the above process, whenever a basic image (for instance, G10 in FIG. 12) is reduced in size at one level, a plurality of variable-sized paragraphs (variable-sized elementary images) of the basic image can be simultaneously reduced for the one level, e.g. such that G40 (identical to G10)→G41→G42→ . . . , as shown in FIG. 16. In this case, an extent of the reduction of the size at one reduction step can be made large, which enables the speed of scale-down processing to be enhanced, when the size of a basic image and the size of a printable print image are widely different from each other, for instance.

Further, the tape printing apparatus 1 can be configured such that a method of sequentially reducing each of the above variable-sized paragraphs (variable-sized elementary images) (FIG. 12 reduction procedure) and a method of reducing a plurality of variable-sized paragraphs (variable-sized elementary images) at one reduction level at a time can be selected according to the settings of modes or the like.

As described above, in the tape printing apparatus 1, a basic image having a plurality of elementary images comprised of one or more fixed-sized elementary images (images in "NON-EASY AUTO PAR." as fixed-sized paragraphs) and one or more variable-sized elementary images (images in "EASY AUTO PAR. " as variable-sized paragraphs) is formed, and in reducing the size of the basic images, at least one of the variable-sized elementary images is reduced in size (scaled down). Hence, the size of the fixed-sized elementary images is not changed, even if the basic image is reduced in size such that the same can be printed within the printing area.

Therefore, if elementary images are distinguished from each other according to their size characteristics in forming a basic image constituted by the elementary images, e.g. by setting an important elementary image as a fixed-sized elementary image and an unimportant elementary image as a variable-sized elementary image, the user's intention which he had in creating the basic image is reflected on a print image as well.

As a result, according to the tape printing apparatus 1, it is possible to reduce an original basic image in size such that the same can be printed in the preset printing area, and reflect the user's intention which he had in forming the basic image, on a print image formed by reducing the basic image.

Further, according to the tape printing apparatus 1, it is possible to set a character size-setting mode or the like to each of created elementary images (created paragraphs) to thereby set the same as a fixed-sized elementary image or a variable-sized elementary image.

Therefore, it is possible to set an important elementary image as a fixed-sized elementary image and an unimportant elementary image as a variable-sized elementary image, for instance, thereby forming a basic image whose elementary images have size characteristics thereof different from each other. This makes it possible to more clearly reflect the user's intention that he had in creating each elementary image of the basic image, on a print image.

Further, a size characteristic can be set to each elementary image formed, which makes it possible to cope with an undesired layout or the incapability of printing by changing size characteristics set to elementary images, when it is determined that a print image is not laid out as desired or cannot be printed within the printing area.

Although in the above embodiment, variable-sized paragraphs (variable-sized elementary images) arranged along the length of a tape are reduced in the direction of the length thereof, this is not limitative, but when a plurality of paragraphs (elementary images) are arranged in the direction of the width of a tape, the plurality of paragraphs (elementary images) can be laterally reduced, thereby enabling the paragraphs to be printed in a laterally-limited printing area, or it is possible to reduce the paragraphs in the directions of the length and width thereof.

Further, although in FIG. 5, description is made assuming that interrupt handling responsive to key entries is carried out, this is not limitative, but the same control process can be realized by other methods, such as a method of management of independent programs for respective different processes, by multitask processing.

Further, as a tape fed from a tape cartridge, there may be employed not only a release paper (peel-off paper) -backed adhesive tape but also a tape without using a release paper (peel-off paper), such as a transfer tape and an iron print transfer tape, which are commercially available.

Still further, the printing device incorporating the print image-forming device according to the invention can be applied not only to a tape printing apparatus but also to a stamp making apparatus which is capable of printing mask data items for obtaining a stamp image to be formed on the stamping face of a stamp, on a ribbon tape. Further, a print material is not required to be a tape, and the print image-forming method and device according to the invention can be applied to still other printing devices which print a print image in a printing area set beforehand on a print material.

Although in the above embodiments a tape as a print material is moved, this is not limitative, but the printing device incorporating the print image-forming device according to the invention may be applied to a printing apparatus of a type which loads a print head (thermal head or the like) e.g. on a carriage for relatively moving the thermal head with respect to a print material fixedly set, or alternatively the same may be applied to a printing apparatus of a type which moves both a tape as a print material and a thermal head with respect to each other.

Further, in the case of the print head of a printing apparatus being a thermal head, the printing device incorporating the print image-forming device according to the invention can be applied to a tape printing apparatus, irrespective of a type thereof, such as a sublimation transfer type in which sublimation of ink is effected, a melting transfer type or the like, so long as the tape printing apparatus carries out printing by using heating elements of thermal heads.

Still further, when a print material is a heat sensitive paper (thermal paper), printing can be effected by generating a predetermined range of heat to suitably change the color of a printed portion of the paper and directly applying the heat to the print material.

Furthermore, although in the above embodiments, the thermal head is used as a print head, the printing device can be applied to a printing apparatus which employs a print head of another type, e.g. of an ink jet type or the like. Moreover, both a cut paper and a continuous paper can be employed as print materials in the printing device.

As described hereinabove, according to the print image-forming method and device of the invention and the printing device incorporating the print image-forming device, it is possible to reduce an original basic image in size such that the same can be printed within a preset printing area, and reflect the user's intention which he had in forming the basic image, on a print image formed by reducing the basic image.

It is further understood by those skilled in the art that the foregoing are preferred embodiments of the invention, and that various changes and modification may be made without departing from the spirit and scope thereof.

What is claimed is:

1. A method of forming a print image to be printed in a preset printing area on a print material, the method comprising the steps of:

creating a basic image having a plurality of elementary images including at least one fixed-sized elementary image and at least one variable-sized elementary image; and forming a reduced image of said basic image as said print image by reducing at least one of said at least one variable-sized elementary image of said basic image in size, when said basic image cannot be printed as said print image within said printing area.

2. A method according to claim 1, wherein the step of creating said basic image includes the steps of:

forming said plurality of elementary images; and setting a size characteristic to each of said elementary images formed, said size characteristic including a setting concerning whether said each of said elementary images formed is one of said at least one fixed-sized elementary image or one of said at least one variable-sized elementary image.

3. A method according to claim 1 or 2, wherein the step of forming said reduced image includes the steps of:

selecting at least one scale-down ratio from a plurality of scale-down ratios at which said at least one variable-sized elementary image is reduced in size; and reducing said at least one variable-sized elementary image at the selected at least one scale-down ratio.

4. A method according to claim 3, wherein the step of selecting said at least one scale-down ratio includes selecting said at least one scale-down ratio such that said reduced image has a largest size of all possible sizes to which said basic image can be reduced in size by using said scale-down-ratios.

5. A method according to claim 4, wherein the step of selecting said at least one scale-down ratio includes the steps of:

provisionally selecting one of said scale-down ratios in a decreasing order;

calculating a size of said reduced image by using at least the provisionally selected scale-down ratio; and actually selecting the provisionally selected scale-down ratio when the calculated size is equal to or smaller than a size of said printing area.

6. A method according to claim 3, further including the step of issuing an error message when a size of said reduced image calculated by applying a smallest scale-down ratio of said scale-down ratios to all of said at least one variable-sized elementary image is larger than a size of said printing area.

7. A method according to claim 3, wherein said at least one variable-sized elementary image is constituted by a plurality of variable-sized elementary images, and wherein the step of selecting said at least one scale-down ratio includes the steps of:

provisionally selecting one of said scale-down ratios in a decreasing order;

sequentially increasing a number of selected ones of said variable-sized elementary images to which the provisionally selected scale-down ratio is applied, by an incremental value of one;

calculating a size of said reduced image by using at least the provisionally selected scale-down ratio whenever the number of the selected variable-sized elementary images to which the provisionally selected scale-down ratio is applied is increased; and actually selecting at least the provisionally selected scale-down ratio when the calculated size is equal to or smaller than a size of said printing area.

8. A method according to claim 3, wherein said at least one variable-sized elementary image is constituted by a plurality of variable-sized elementary images, and wherein the step of selecting said at least one scale-down ratio includes the steps of:

provisionally selecting one of said scale-down ratios in a decreasing order;

calculating a size of said reduced image by applying the provisionally selected scale-down ratio to all of said variable-sized elementary images; and actually selecting the provisionally selected scale-down ratio when the calculated size is equal to or smaller than a size of said printing area.

9. A method according to claim 1, wherein said at least one variable-sized elementary image includes one containing at least one character image, said at least one character image having a plurality of character sizes to which said at least one character image can be set, and wherein the step of forming said reduced image includes changing an original character size of each of said at least one character image to a character size smaller than said original character size by selecting an appropriate one of said character sizes.

10. A method according to claim 9, wherein the variable-sized elementary image containing said at least one character image includes a variable-sized elementary image containing a plurality of lines of character images, and wherein the step of forming said reduced image includes selectively setting said character sizes to said plurality of lines such that said character images are reduced at an identical scale-down ratio.

11. A method according to claim 1, wherein said at least one variable-sized elementary image includes one containing a plurality of character images and at least one blank image located between adjacent ones of said character images, said at least one blank image being each formed of an image other than character images, and wherein the step of forming said reduced image includes reducing a size of each of said at least one blank image.

12. A method according to claim 1, wherein said at least one variable-sized elementary image includes one containing at least one character image and marginal blank images forward and backward of said at least one character image, and wherein the step of forming said reduced image includes reducing a size of said marginal blank images.

13. A method according to claim 1, wherein said print material is a tape.

14. A method according to claim 13, wherein said basic image is formed by arranging said plurality of elementary images in a direction corresponding to a direction of a length of said tape.

15. A method according to claim 13, wherein said plurality of elementary images correspond respectively to a plurality of paragraphs to be printed on said tape.

16. A print image-forming device for forming a print image to be printed in a preset printing area on a print material, the print image-forming device comprising:

basic image-creating means for creating a basic image having a plurality of elementary images including at least one fixed-sized elementary image and at least one variable-sized elementary image; and reduced image-forming means for forming a reduced image of said basic image as said print image by reducing at least one of said at least one variable-sized elementary image of said basic image in size, when said basic image cannot be printed as said print image within said printing area.

17. A print image-forming device according to claim 16, wherein said basic image-creating means includes:

elementary image-forming means for forming said plurality of elementary images; and size characteristic-setting means for setting a size characteristic to each of said elementary images formed, said size characteristic including a setting concerning whether said each of said elementary images formed is one of said at least one fixed-sized elementary image or one of said at least one variable-sized elementary image.

18. A print image-forming device according to claim 16 or 17, wherein said reduced image-forming means includes:

scale-down ratio-selecting means for selecting at least one scale-down ratio from a plurality of scale-down ratios at which said at least one variable-sized elementary image is reduced in size; and reducing means for reducing said at least one variable-sized elementary image at the selected at least one scale-down ratio.

19. A print image-forming device according to claim 18, wherein said scale-down ratio-selecting means selects said at least one scale-down ratio such that said reduced image has a largest size of all possible sizes to which said basic image can be reduced in size by using said scale-down ratios.

20. A print image-forming device according to claim 19, wherein said scale-down ratio-selecting means includes:

provisional selection means for provisionally selecting one of said scale-down ratios in a decreasing order;

size-calculating means for calculating a size of said reduced image by using at least the provisionally selected scale-down ratio; and actual selection means for actually selecting the provisionally selected scale-down ratio when the calculated size is equal to or smaller than a size of said printing area.

21. A print image-forming device according to claim 18, further including notification means for issuing an error message when a size of said reduced image calculated by applying a smallest scale-down ratio of said scale-down ratios to all of said at least one variable-sized elementary image is larger than a size of said printing area.

22. A print image-forming device according to claim 18, wherein said at least one variable-sized elementary image is constituted by a plurality of variable-sized elementary images, and wherein said scale-down ratio-selecting means includes:

provisional selection means for provisionally selecting one of said scale-down ratios in a decreasing order;

applied variable-sized elementary image number-increasing means for sequentially increasing a number of selected ones of said variable-sized elementary images to which the provisionally selected scale-down ratio is applied, by an incremental value of one;

size-calculating means for calculating a size of said reduced image by using at least the provisionally selected scale-down ratio whenever the number of the selected variable-sized elementary images to which the provisionally selected scale-down ratio is applied is increased; and actual selection means for actually selecting at least the provisionally selected scale-down ratio when the calculated size is equal to or smaller than a size of said printing area.

23. A print image-forming device according to claim 18, wherein said at least one variable-sized elementary image is constituted by a plurality of variable-sized elementary images, and wherein said scale-down ratio-selecting means includes:

provisional selection means for provisionally selecting one of said scale-down ratios in a decreasing order;

size-calculating means for calculating a size of said reduced image by applying the provisionally selected scale-down ratio to all of said variable-sized elementary images; and actual selection means for actually selecting the provisionally selected scale-down ratio when the calculated size is equal to or smaller than a size of said printing area.

24. A print image-forming device according to claim 16, wherein said at least one variable-sized elementary image includes one containing at least one character image, said at least one character image having a plurality of character sizes to which said at least one character image can be set, and wherein said reduced image-forming means includes character size-changing means for changing an original character size of each of said at least one character image to a character size smaller than said original character size by selecting an appropriate one of said character sizes.

25. A print image-forming device according to claim 24, wherein the variable-sized elementary image containing said at least one character image includes a variable-sized elementary image containing a plurality of lines of character images, and wherein said reduced image-forming means includes character size-setting means for selectively setting said character sizes to said plurality of lines such that said character images are reduced at an identical scale-down ratio.

26. A print image-forming device according to claim 16, wherein said at least one variable-sized elementary image includes a variable-sized elementary image containing a plurality of character images and at least one blank image located between adjacent ones of said character images, said at least one blank image being each formed of an image other than character images, and wherein said reduced image-forming means includes means for reducing a size of each of said at least one blank image.

27. A print image-forming device according to claim 16, wherein said at least one variable-sized elementary image includes a variable-sized elementary image containing at least one character image and marginal blank images forward and backward of said at least one character image, and wherein said reduced image-forming means includes means for reducing a size of said marginal blank images.

28. A print image-forming device according to claim 16, wherein said print material is a tape.

29. A print image-forming device according to claim 28, wherein said basic image is formed by arranging said plurality of elementary images in a direction corresponding to a direction of a length of said tape.

30. A print image-forming device according to claim 28, wherein said plurality of elementary images correspond respectively to a plurality of paragraphs to be printed on said tape.

31. A printing apparatus comprising:

a print image-forming device for forming a print image to be printed in a preset printing area on a print material, the print image-forming device including:

basic image-creating means for creating a basic image having a plurality of elementary images including at least one fixed-sized elementary image and at least one variable-sized elementary image; and reduced image-forming means for forming a reduced image of said basic image as said print image by reducing at least one of said at least one variable-sized elementary image of said basic image in size, when said basic image cannot be printed as said print image within said printing area; and printing means for printing said print image formed by said print image-forming device in said printing area.

32. A method according to claim 1, wherein the step of creating a basic image includes the steps of designating a fixed-sized elementary image and designating at least one variable-sized elementary image.

33. A print image-forming device according to claim 16 or 31, wherein the basic image-creating means includes means for designating a fixed-sized elementary image and means for designating at least one variable-sized elementary image.

* * * * *

UNITED STATES PATENT AND TRADEMARK OFFICE
CERTIFICATE OF CORRECTION

PATENT NO : 6,129,467

DATED : October 10, 2000

INVENTOR(S): Yoshiya TOYOSAWA; Kenji WATANABE; Takuya SUETANI; Kiyoshi OGAWA; Tomoyuki SHIMMURA It is certified that error appears in the above-identified patent and that said Letters Patent are hereby corrected as shown below:

Col. 1, line 75, change "Shimmra" to --Shimmura--.

Col. 1, line 73, insert "King Jim Co., Ltd. of Japan"

Signed and Sealed this

Fifteenth Day of May, 2001

*Attest:*

Nicholas P. Godici

NICHOLAS P. GODICI

*Attesting Officer*

*Acting Director of the United States Patent and Trademark Office*